US005977944A

United States Patent [19]

Kubota et al.

[11] Patent Number: 5,977,944

[45] Date of Patent: Nov. 2, 1999

[54] DATA SIGNAL OUTPUT CIRCUIT FOR AN IMAGE DISPLAY DEVICE

[75] Inventors: Yasushi Kubota, Sakurai; Kenichi Katoh, Higashihiroshima; Ichiro Shiraki, Tenri, all of Japan

[73] Assignee: Sharp Kabushiki Kaisha, Osaka, Japan

[21] Appl. No.: 08/909,481

[22] Filed: Aug. 11, 1997

[30] Foreign Application Priority Data

Aug. 29, 1996 [JP] Japan ..... 8-229042

[51] Int. Cl.[6] ..... G09G 3/36

[52] U.S. Cl. ..... 345/100; 345/98; 345/89; 345/99

[58] Field of Search ..... 345/100, 98, 89, 345/197, 198, 99; 377/64

[56] References Cited

U.S. PATENT DOCUMENTS

| | | | |
|---|---|---|---|
| 5,038,139 | 8/1991 | Fujisawa et al. | 345/89 |
| 5,359,343 | 10/1994 | Nakamura | 345/100 |
| 5,465,053 | 11/1995 | Edwards | 324/770 |
| 5,764,212 | 6/1998 | Nishitani et al. | 345/98 |
| 5,781,171 | 7/1998 | Kihara et al. | 345/93 |
| 5,796,379 | 8/1998 | Enomoto et al. | 345/89 |
| 5,798,742 | 8/1998 | Watatani et al. | 345/98 |
| 5,801,674 | 9/1998 | Shimizu | 345/103 |
| 5,852,429 | 12/1998 | Scheffer et al. | 345/100 |
| 5,859,627 | 1/1999 | Hoshiya et al. | 345/100 |
| 5,861,863 | 1/1999 | Kudo et al. | 345/100 |

FOREIGN PATENT DOCUMENTS

| | | |
|---|---|---|
| 63-50717 | 10/1988 | Japan . |
| 63-271298 | 11/1988 | Japan . |
| 5-325584 | 12/1993 | Japan . |

OTHER PUBLICATIONS

U.S. application No. 08/841585, Kubota et al., filed Apr. 1997.

*Primary Examiner*—Richard A. Hjerpe
*Assistant Examiner*—Marthe Y Marc-Coleman
*Attorney, Agent, or Firm*—Nixon & Vanderhye P.C.

[57] ABSTRACT

A data signal output circuit is divided into a plurality of blocks, each having its own supply circuit. In each block, a plurality of shift register sections, constituting a shift register, output pulse signals which have been shifted according to clock signals. Driving sections sample a digital image signal in synchronism with the pulse signal, and output data signals corresponding to the image signal thus sampled to a plurality of output lines. Each supply circuit provided in the blocks receives the image signal when the image signal should be sampled by the driving sections, thereby supplying the image signal only to the minimum number of blocks to be operated. In this manner, the image signal is selectively supplied to the block so as to reduce the effective load on the image signal. As a result, the power consumption generated in the image signal lines can be reduced.

58 Claims, 26 Drawing Sheets

DATA SIGNAL OUTPUT CIRCUIT FOR AN IMAGE DISPLAY DEVICE

FIELD OF THE INVENTION

The present invention relates to a data signal output circuit which selects and outputs predetermined data according to a digital signal input, and more particularly relates to a data signal output circuit suited for outputting image display-use data, and an image display device adopting the data signal output circuit.

BACKGROUND OF THE INVENTION

A liquid crystal display device of the active matrix driving system is well known as one type of a conventional liquid crystal display device. As shown in FIG. 19, the liquid crystal display device of this type is provided with a pixel array 1, a scanning signal line driving circuit (referred to as gate driver hereinafter) 2, and a data signal line driving circuit (referred to as source driver hereinafter) 3. The pixel array 1 includes a number of scanning signal lines GL and a number of data signal lines SL intersecting each other, and pixels (PIX in FIG. 19) 4 arranged in a matrix.

As shown in FIG. 20, the pixel 4 is provided with a pixel transistor SW as a switching element and pixel capacitor $C_p$ including liquid crystal capacitor $C_L$ (storage capacitor $C_S$ is supplied as required). In the pixel 4 having the above arrangement, in the case where a voltage is applied to the liquid crystal capacitor $C_L$, the transmissivity or the reflectance of the liquid crystal is modulated, and an image is displayed on the pixel array 1 in accordance with an image signal DAT.

The source driver 3 makes sampling of an inputted image signal DAT, and outputs gradation display-use data corresponding to the image signal DAT thus sampled to each data signal line SL. The gate driver 2 sequentially selects the scanning signal lines GL, and controls the opening and closing of the pixel transistor SW provided in the pixel 4. With this arrangement, the image signal (data) outputted to each data signal line SL is written into each pixel 4 and kept therein.

Incidentally, a conventional liquid crystal display device of the active matrix type preferably adopts an amorphous silicon thin film as a material for the pixel transistor SW. The amorphous silicon thin film is provided on a transparent substrate made of, for example, glass. Additionally, each of the gate driver 2 and the source driver 3 is realized by integrated circuits (IC) that are externally attached.

In contrast, in recent years, in response to a demand for improving a driving power of the pixel transistor SW due to a trend for a larger screen, for lowering the cost of mounting a driving IC, and for improving the reliability of the device upon mounting the driving IC, technology has been developed and reported for monolithically forming the pixel array 1 and the drivers 2 and 3 with a polycrystal silicon thin film. Further, in order to realize an image display device having a larger screen at a lower cost, an attempt has been made to form an active element with the polycrystal silicon thin film on a glass substrate at a processing temperature of not more than a distortion point of glass (substantially 600° C.).

For example, the liquid crystal display device of FIG. 21 adopts an arrangement wherein a pixel array 1, a gate driver 2, and a source driver 3 are provided on the glass substrate 5, and a timing signal generating circuit 6 and a power source voltage generating circuit 7 are connected to the pixel array 1, the gate driver 2, and the source driver 3.

Here, an arrangement of the source driver 3 will be described. The source driver 3 can be classified into an analog type and a digital type depending on the kind of an inputted signal. In a polycrystal silicon TFT panel in which the drivers and the pixels are integrated, the analog type, especially a driver of the point sequential driving system is widely used because of its simple circuit arrangement. On the other hand, in a portable information terminal, which has been spreading rapidly in recent years, in the light of the arrangement of the system and the power consumption, it is preferable that the source driver 3 is of the digital type since the image signal is a digital signal.

The following will explain a source driver of the point sequential driving system as one example of the analog driver, and a source driver of the multi-plexer system as one example of the digital driver.

As shown in FIG. 27, in the analog type source driver of the point sequential driving system, sampling switches 13 open and close in synchronism with a pulse signal outputted from a scanning circuit 11 constituting each stage of a shift register. As a result, an analog image signal DAT (signal corresponding to three primary colors R, G, B) is outputted to the data signal line SL (SL(R), SL(G), SL(B)). Here, a buffer circuit 12 receives the pulse signal from the scanning circuit 11, and holds and amplifies the pulse signal. The buffer circuit 12 also generates a reverse signal of the pulse signal thus held and amplified as required.

As described, in the source driver of the point sequential driving system, it is required to output the analog image signal DAT to the data signal line SL within a period of time corresponding to a width of the pulse signal (tens of n sec to hundreds of n sec), thereby requiring a transistor having an excellent property (large driving power) as a sampling switch 13. Further, since the analog signal is in use, it is required to suppress the non-uniform property of each transistor.

On the other hand, the digital type source driver of the multi-plexer system operates in the following manner. As shown in FIG. 24, an inputted digital image signal DIG of 9 bits (signal corresponding to three primary colors R, G, B, 3 bits for each color) is sampled bit by bit in a latch 14 in synchronism with the pulse signal from the scanning circuit 11.

Transfer circuit 15 transfers each signal of 1 bit thus sampled at a time to a decoder 16 during a horizontal blanking period, and the transferred signals are decoded by the decoder 16. As a result, 8 decode signals per RGB are outputted from the decoder 16, and are supplied respectively to 8 analog switches 17. Then, one of 8 gradation voltages VGS is selected per RGB in accordance with the decode signals by the analog switches 17, and is outputted to the data signal lines SL (R), SL(G), and SL(B).

Incidentally, in the driving system as described above, an analog circuit such as an amplifier, which consumes a large amount of power is not employed in the driving circuit. For this reason, among the total power consumption associated with externally inputted signals such as clock signals becomes relatively greater. This is because among circuits following the shift registers, only the circuits of one stage are operated (circuits of several stages in the case of operating several stages at a time in parallel), whereas externally inputted signals are sent to the circuits of all stages simultaneously, thereby extremely increasing the capacitive load on the external input signal-use input lines.

Particularly, in the image display device of a driver-pixel integrated type, a polycrystal silicon thin film transistor is widely adopted as an active element. The polycrystal silicon thin film transistor has a larger active element size and higher driving voltage than that of monocrystal silicon transistor, thereby further increasing the power consumption associated with the externally inputted signals.

Therefore, in the image display device adopting the above-described driving system, the reduction of the loads of the externally inputted signals is effective in reducing the power consumption. The technology for reducing the power consumption in this manner is disclosed in Japanese Examined Patent Publication No. 50717/1988 (Tokukousho 63-50717) which discloses that a plurality of flip-flops constituting the shift register are divided into a plurality of groups in order to selectively supply a clock signal to each group per certain time intervals in the analog type data signal line driving circuit (data sample circuit) of the point sequential system. According to this method, the power consumption of the shift registers can be remarkably reduced.

On the other hand, in the digital type data signal line driving circuit of the multi-plexer system, the above-described method can also be adopted so as to reduce the power consumption associated with the clock signals. However, because the multi-plexer system requires a large number of image signal lines, the power consumption associated with the image signal lines increases to a level that can not be ignored.

For example, in the case of displaying an image in 512 colors, the number of the digital image signals are 9 (3 bits for each RGB), thereby requiring 9 image signal lines for inputting the digital image signals. In an arrangement wherein a number of image signal lines are provided as above, it is likely that the power consumption associated with the image signal lines, although it depends on a display pattern, exceeds the power consumption associated with the clock signal lines. Further, an image display device which displays an image in a larger number of colors, obviously, becomes affected more noticeably.

SUMMARY OF THE INVENTION

It is an object of the present invention to provide a data signal line driving circuit (data signal output circuit) for reducing the power consumption associated with digital image signal lines and clock signal lines, and it is another object of the present invention to provide an image display device provided with such a data signal line driving circuit.

In order to achieve the above-mentioned objects, a data signal output circuit which is divided into a plurality of blocks includes:

- a shift register for shifting a scanning signal one after another so as to output the scanning signal in synchronism with a clock signal, the shift register being divided into a plurality of parts in accordance with the blocks;
- a select output unit for making a sampling of an inputted digital signal in synchronism with the scanning signal, and for outputting a data signal corresponding to the digital signal thus sampled to a plurality of output lines, the select output unit being divided into a plurality of parts as the shift register; and
- a supply circuit, provided in the each block, for supplying the digital signal to a divided part of the select output circuit in the each block at least during a period of time in which the divided part should operate.

With this arrangement, since the supply circuit is provided in each block, a digital signal, which has been externally inputted during a period of time when a select output unit in a specific block should be operated, is supplied to the block by the supply circuit. As a result, it is avoided that the digital signal is supplied to all the blocks simultaneously. Therefore, the effective load on the signal line (digital signal line) for supplying a digital signal can be reduced, thereby greatly reducing the power consumption of thus data signal output circuit.

For a fuller understanding of the nature and advantages of the invention, reference should be made to the ensuing detailed description taken in conjunction with the accompanying drawings.

DESCRIPTION OF EXEMPLARY EMBODIMENTS

The following will explain one embodiment of the present invention referring to FIG. 1 through FIG. 18. The following explanation will be based on a first through fifth data signal output circuits as specific examples of data signal output circuits in accordance with the present embodiment.

First Data Signal Output Circuit

Figure 1:
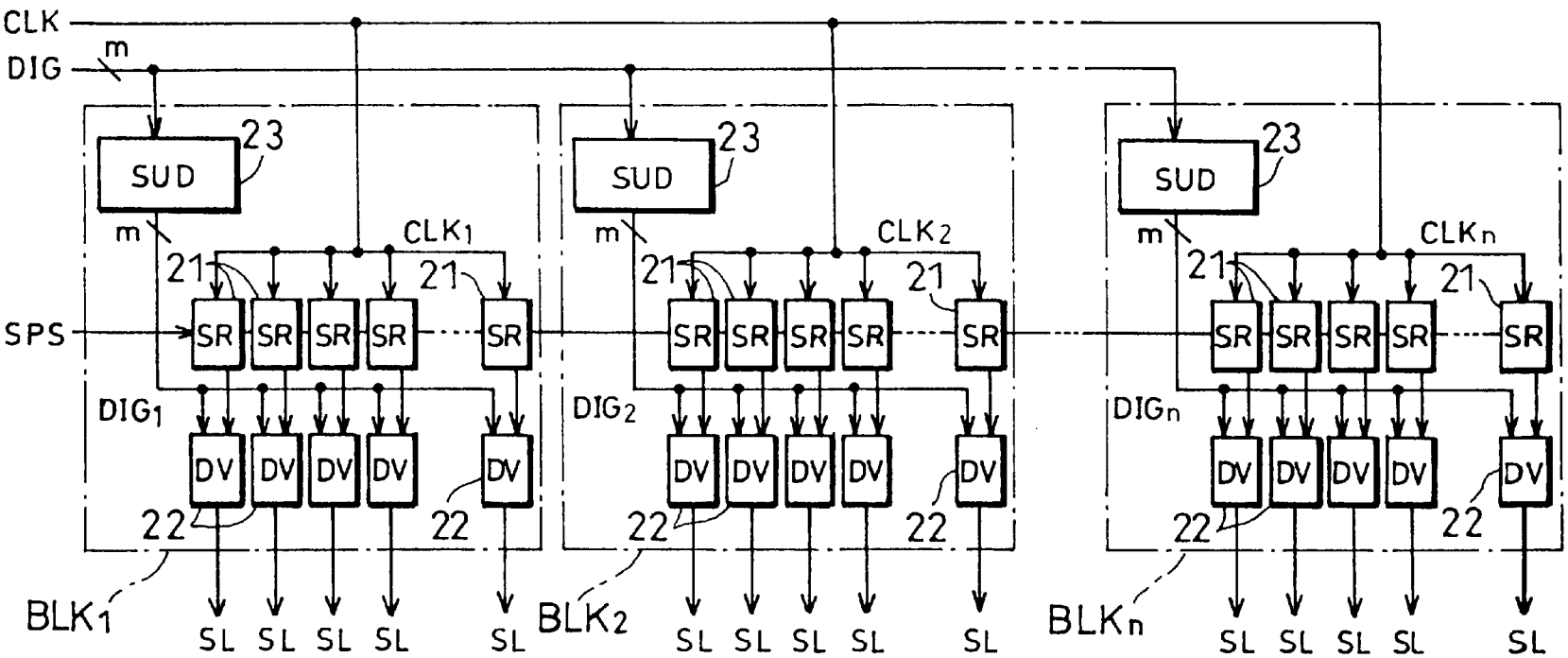
FIG. 1 is a block diagram showing an arrangement of a first data signal output circuit in accordance with one embodiment of the present invention.

As shown in FIG. 1, the first data signal output circuit is divided into n blocks $BLK_1$ to $BLK_n$. Each of the blocks $BLK_1$ to $BLK_n$ is provided with shift register sections (SR in FIG. 1) 21, driving sections (DV in FIG. 1) 22, and a supply circuit (SUD in FIG. 1) 23.

Figure 2:
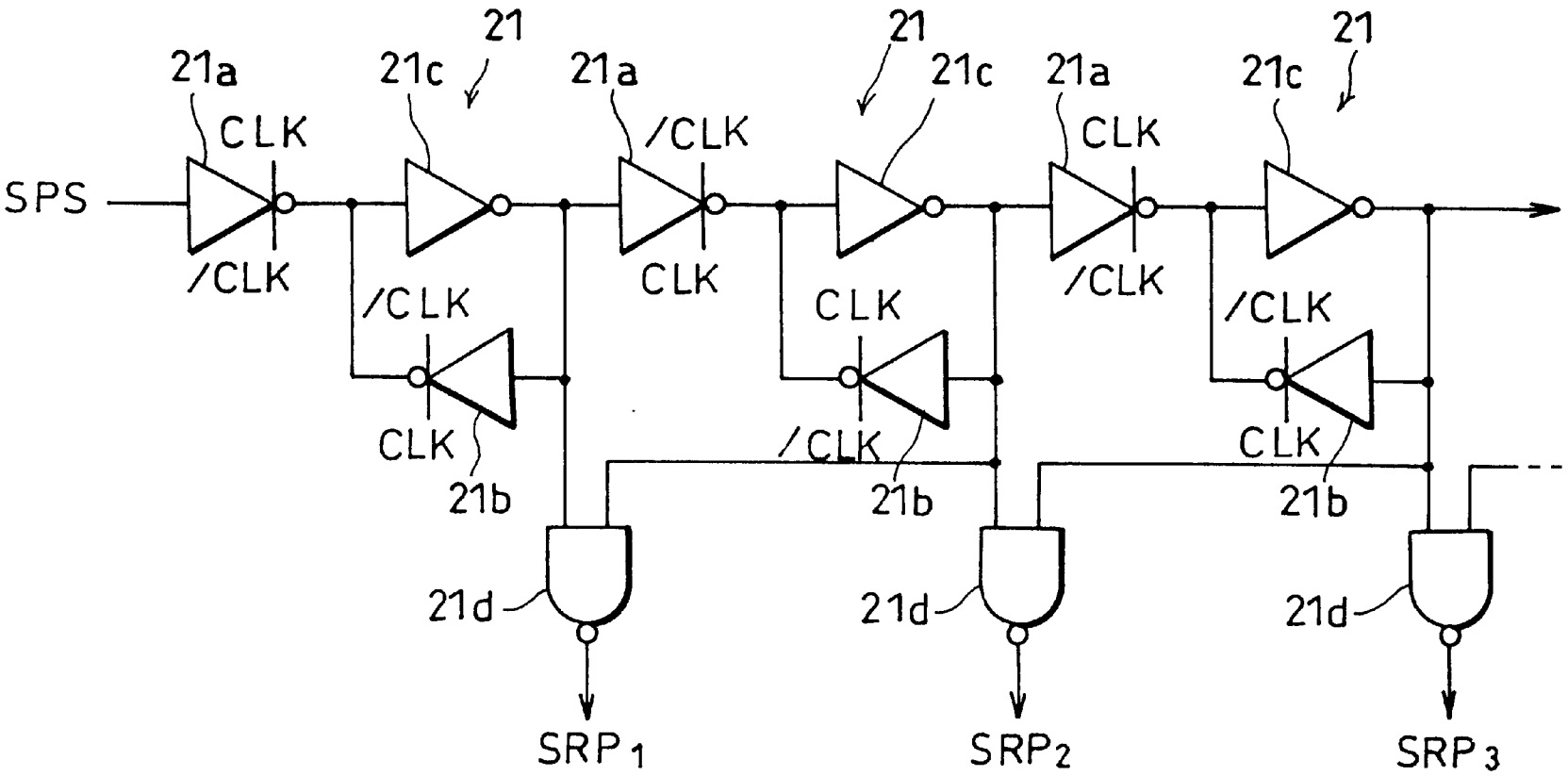
FIG. 2 is a circuit diagram showing an arrangement of a shift register section in the first data signal output circuit.

As shown in FIG. 2, the shift register section 21 is composed of clocked inverters 21*a* and 21*b*, an inverter 21*c*, and an NAND gate 21*d*. The clocked inverters 21*a* and 21*b* and the inverter 21*c* constitute a latch. A shift register is composed of latches that are connected in series and in multiple-stages (only three stages are shown in FIG. 2).

In the shift register having the above arrangement, a start pulse SPS is shifted one after another in synchronism with a clock signal CLK and a clock signal/CLK which is the reversed signal of the clock signal CLK. Signals outputted from adjacent two latches are subjected to the logical NAND by the NAND gate 21*d*. As a result, pulse signals $SRP_1$, $SRP_2$, and $SRP_3$ are outputted from the shift register sections 21.

A driving section 22 is a circuit which (1) makes a sampling of a digital image signal (hereinafter referred to as simply an image signal) DIG in synchronism with the pulse signal SRP from the shift register section 21, (2) selects one gradation voltage from a plurality of gradation voltages according to the image signal DIG thus sampled, and (3) outputs the gradation voltage as selected to a data signal line SL as a data signal. The driving sections 22 are individually connected to data signal lines SL, and the entire driving sections 22 constitute a select/output section.

As will be mentioned later, a supply circuit 23 as a first supply circuit selectively supplies the image signal DIG of m bits to the blocks $BLK_1$ to $BLK_n$. Here, m indicates the number of bits corresponding to the number of colors of an image. Therefore, in order to supply a signal representing each bit, m image signal lines are provided. Supply circuits having the above-described arrangement are also included in a second through fifth data signal output circuits which will be described later.

Figure 3:
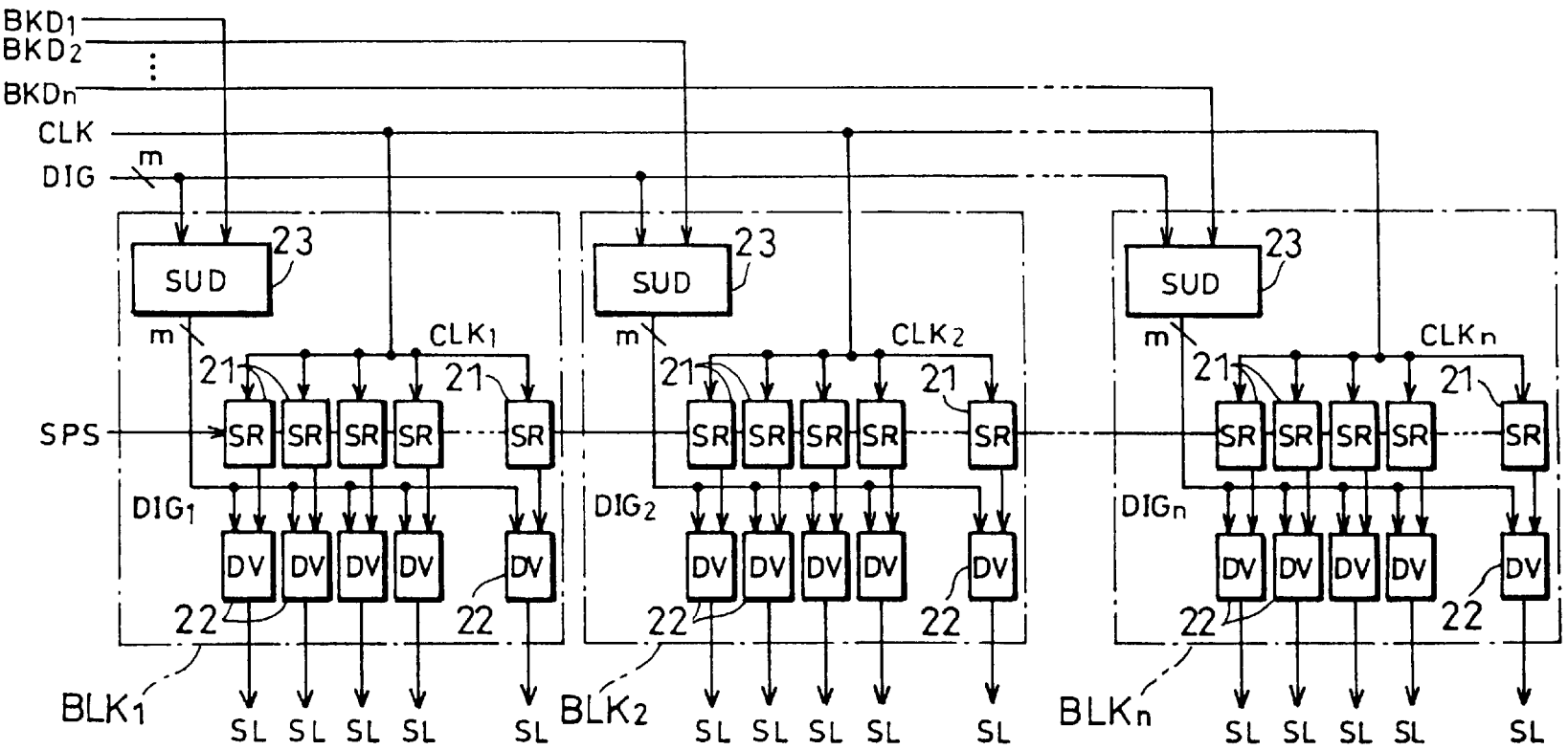
FIG. 3 is a block diagram showing a specific arrangement of the first data signal output circuit.

The first data signal output circuit shown in FIG. 1 is more specifically arranged in the manner shown in FIG. 3. Here, explanations will be given to a block $BLK_i$ among the blocks $BLK_1$ to $BLK_n$.

The supply circuit 23 is controlled by a block select signal $BKD_i$ which is externally inputted in order to supply the image signal DIG of m bits to the driving sections 22 in the block $BLK_i$ at intervals of predetermined period of time.

Figure 4:
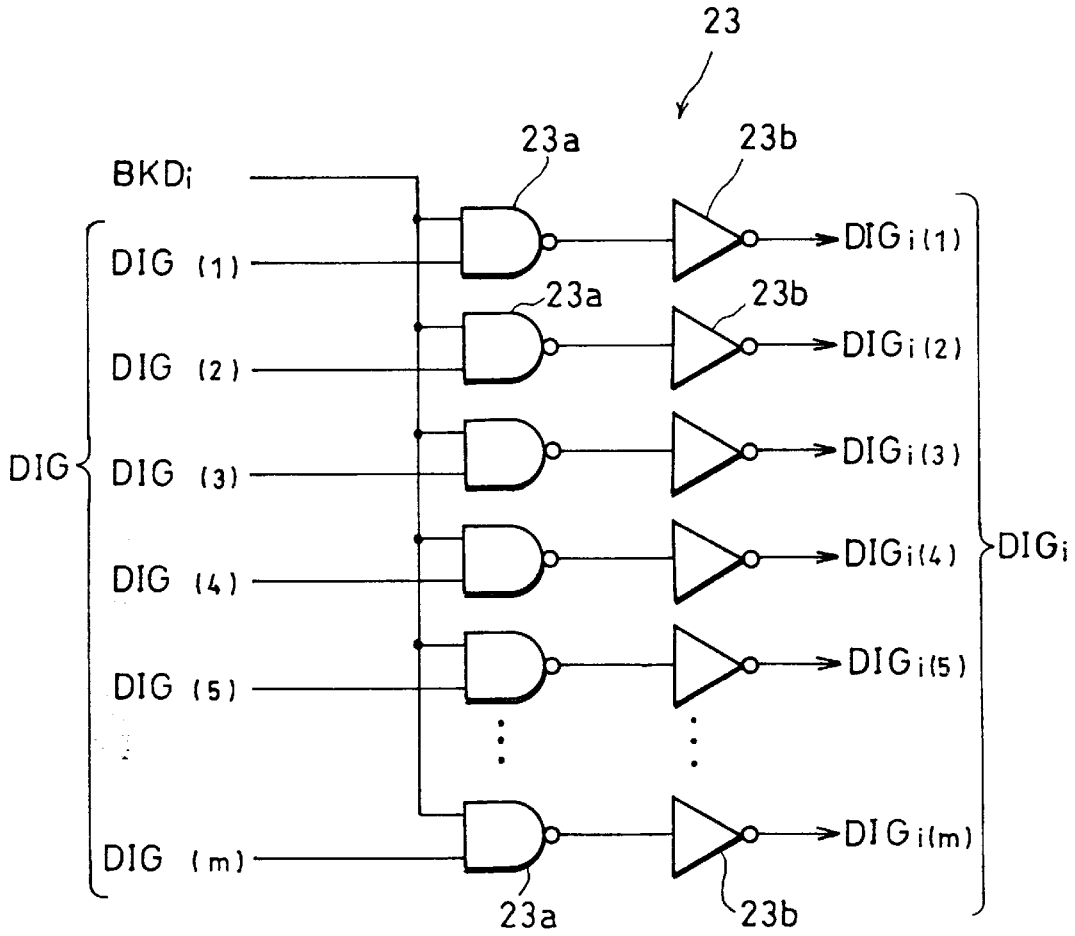
FIG. 4 is a circuit diagram showing an arrangement of a supply circuit in the first data signal output circuit of FIG. 3.

As shown in FIG. 4, the supply circuit 23 includes NAND gates 23*a* and inverters 23*b* having the same number as that of the image signal lines. In the supply circuit 23 having this arrangement, each of bit signals $DIG_{(l)}$ to $DIG_{(m)}$ constituting the image signal DIG, and the block select signal $BKD_i$ are subjected to the logical NAND by the NAND gates 23*a*. Then, the resulting output signals from the NAND gates 23*a* are reversed by the inverters 23*b*. With this arrangement, the image signal $DIG_i$ ($DIG_{i(1)}$ to $DIG_{i(m)}$) is outputted when the block select signal $BKD_i$ is activated, whereas the image signal $DIG_i$ ($DIG_{i(1)}$ to $DIG_{i(m)}$) is not outputted when the block select signal $BKD_i$ is inactivated.

Here, in the case where the image signal $DIG_i$ is not supplied to the block $BLK_i$, the image signal lines in the block $BLK_i$ are biased to a constant voltage.

Figure 5:
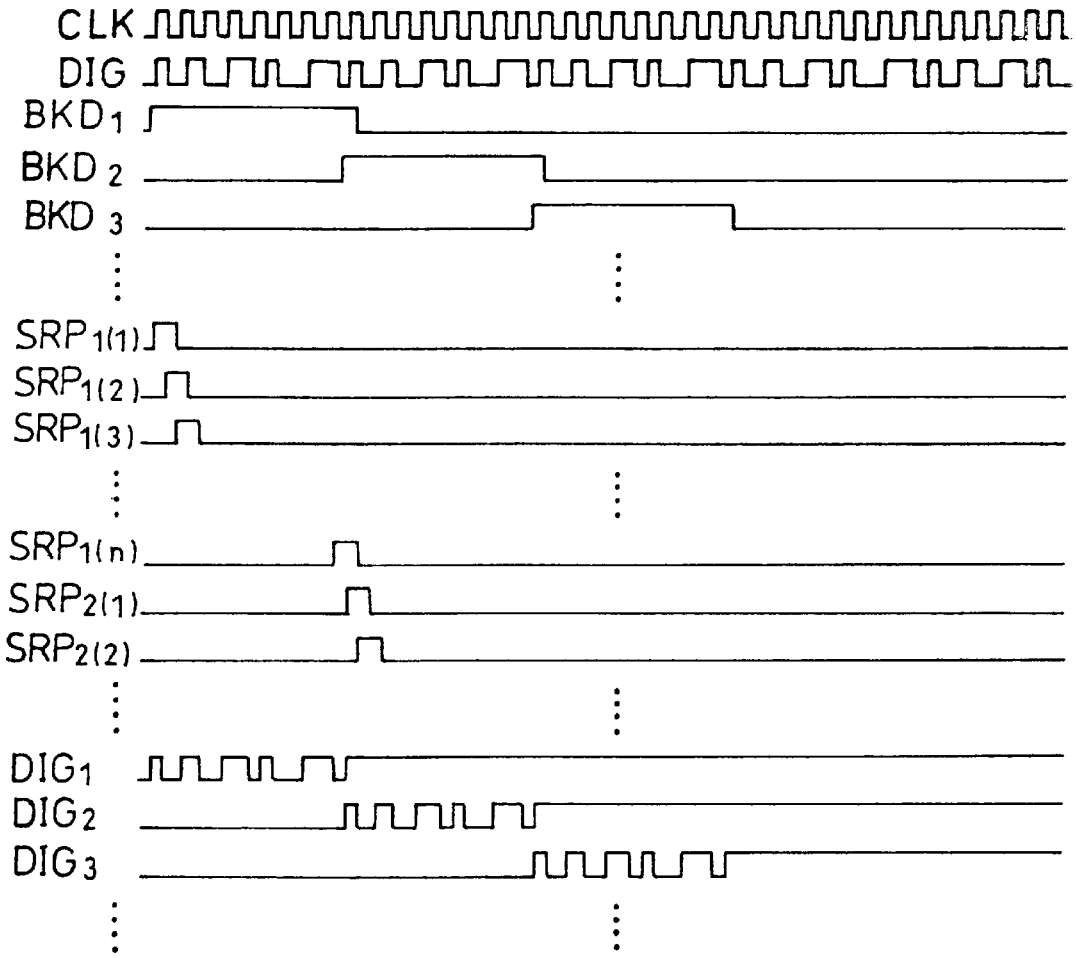
FIG. 5 is a timing chart showing how the first data signal output circuit of FIG. 3 is operated.

The following will explain the operation of the first data signal output circuit having the above arrangement referring to the timing chart of FIG. 5.

First, in the blocks $BLK_1$ to $BLK_n$, the image signals $DIG_1$ to $DIG_n$, are outputted from respective supply circuits 23 while the block select signals $BKD_1$ to $BKD_n$ are activated (high level). Here, the block select signals $BKD_1$ to $BKD_n$ are activated so as to overlap for a predetermined period, thereby avoiding that the head end and the tail end portions of the image signals $DIG_1$ to $DIG_n$ from being missing.

On the other hand, the pulse signals $SRP_{1(l)}$ to $SRP_{1(n)}$ are outputted one after another in synchronism with the clock signal CLK with half a clock delay with respect to the clock signal CLK from the shift register sections 21 of the block $BLK_l$. In the same manner, the pulse signals SRP are also output from the shift register sections 21 of the blocks $BLK_2$ to $BLK_n$.

During the period of time in which the block select signals $BKD_i$ are active, the image signals $DIG_i$ from the supply circuit 23 are sent to respective driving sections 22 in synchronism with the pulse signals SRP from the shift register sections 21. In the driving sections 22, a plurality of gradation voltages (not shown) are selected according to the image signals $DIG_i$, and the gradation voltages thus selected are output to the data signal lines SL as a display-use data signal (data signal).

As described, the first data signal output circuit is arranged so that the supply circuits 23 supply the image signals $DIG_1$ to $DIG_n$ to the divided blocks of $BLK_l$ to $BLK_n$ only in a required minimum time period. Specifically, in the block $BLK_i$ of the first data signal output circuit, the image signals $DIG_i$ are supplied to the block $BLK_i$ according to the block select signals $BKD_i$ which are activated at least during a period of time in which the pulse signals $SRP_i$ are outputted from the shift register sections 21, whereas the image signals $DIG_i$ are not supplied in accordance with the block select signals $BKD_i$ which is inactivated during the period other than such period.

According to this arrangement, it is possible to specify the period in which the image signals DIG should be sent to the driving sections 22 with respect to each block $BLK_i$. Therefore, only the required image signals $DIG_i$ are supplied to the block $BLK_i$. In this manner, the image signals $DIG_i$ are selectively supplied to the block $BLK_i$ as to reduce the effective load on the image signal lines. As a result, the power consumption can be greatly reduced which is associated with the image signals DIG.

Furthermore, optimum block select signals $BKD_l$ to $BKD_n$ are appropriately set with respect to the blocks $BLK_l$ to $BLK_n$ respectively so as to minimize the number of blocks $BLK_i$ to which the image signals DIG are simultaneously supplied, thereby further reducing the load on the image signal lines so as to further reduce the power consumption of the first data signal output circuit.

Note that, in the first data signal output circuit, the effective load on the image signal lines can be further reduced by increasing the number of blocks n. To the contrary, the number of the supply circuits 23 also increases accordingly, thereby increasing the power consumption due to the load in the supply circuits 23, as well as increasing the scale of the first data signal output circuit. Therefore, it is preferable that the optimum number of blocks n should be selected by taking into consideration of the total power consumption of the first data signal output circuit and the scale of the circuit.

Second Data Signal Output Circuit

Figure 6:
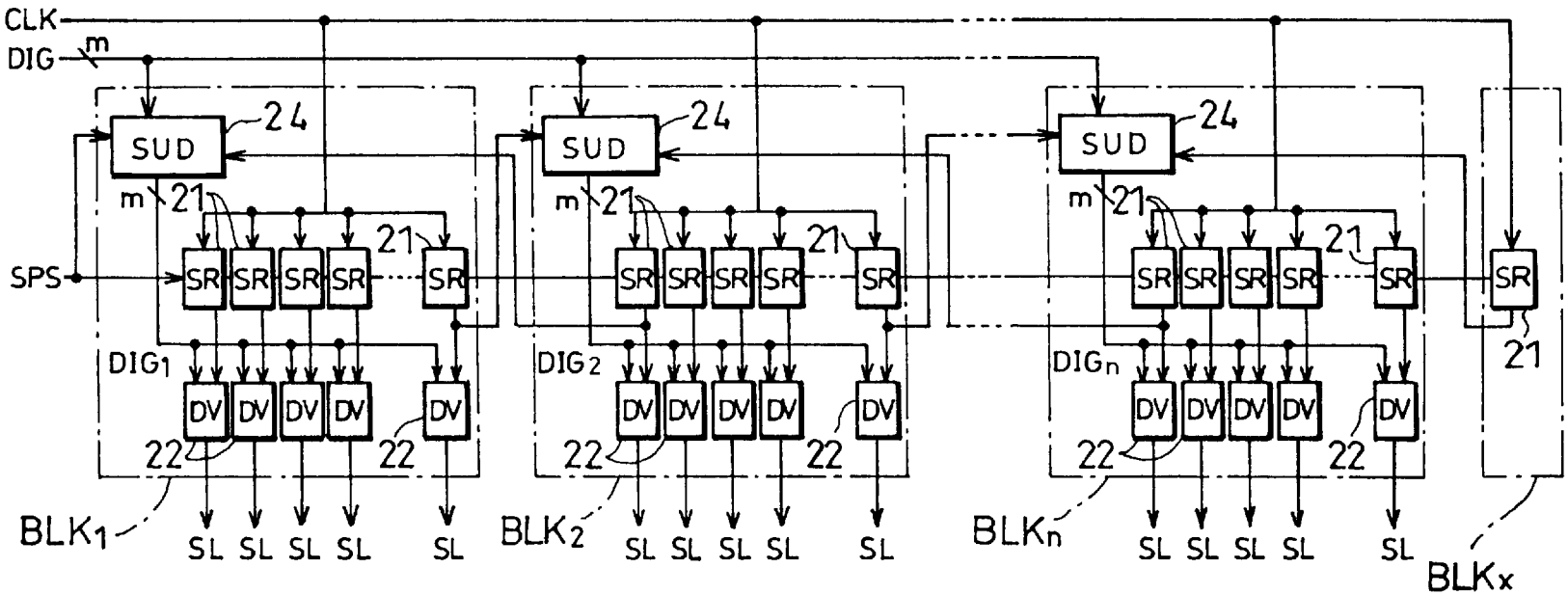
FIG. 6 is a block diagram showing an arrangement of a second data signal output circuit in accordance with one embodiment of the present invention.

As shown in FIG. 6, a second data signal output circuit is divided into the blocks $BLK_1$ to $BLK_n$ as in the first data signal output circuit, and is further provided with a block $BLK_X$. Moreover, the blocks $BLK_1$ to $BLK_n$ are provided with supply circuits 24 instead of the supply circuits 23. The block $BLK_X$ is provided in a stage following the block $BLK_n$, and has one shift register section 21. The shift register section 21 in the block $BLK_X$ is connected in series to the shift register section 21 in the last stage of the block $BLK_n$, and the shift register 21 of the block $BLK_X$ is supplied with a clock signal CLK.

Furthermore, the pulse signals SRP from the shift register sections 21 in the last stages of the blocks $BLK_1$ to $BLK_{n-1}$ are supplied to the supply circuits 24 of blocks $BLK_2$ to $BLK_n$ respectively provided in the following stages. Further, the pulse signals SRP from the shift register sections 21 in the first stages of the blocks $BLK_2$ to $BLK_n$ are supplied to the supply circuits 24 of the blocks $BLK_1$ to $BLK_{n-1}$ respectively provided in the preceding stages of the blocks $BLK_2$ to $BLK_n$.

Here, a start pulse SPS is supplied to the supply circuit 24 of the block $BLK_l$, and a pulse signal SRP from the shift register section 21 of the block $BLK_X$ is supplied to the supply circuit 24 of the block $BLK_n$.

Figure 7:
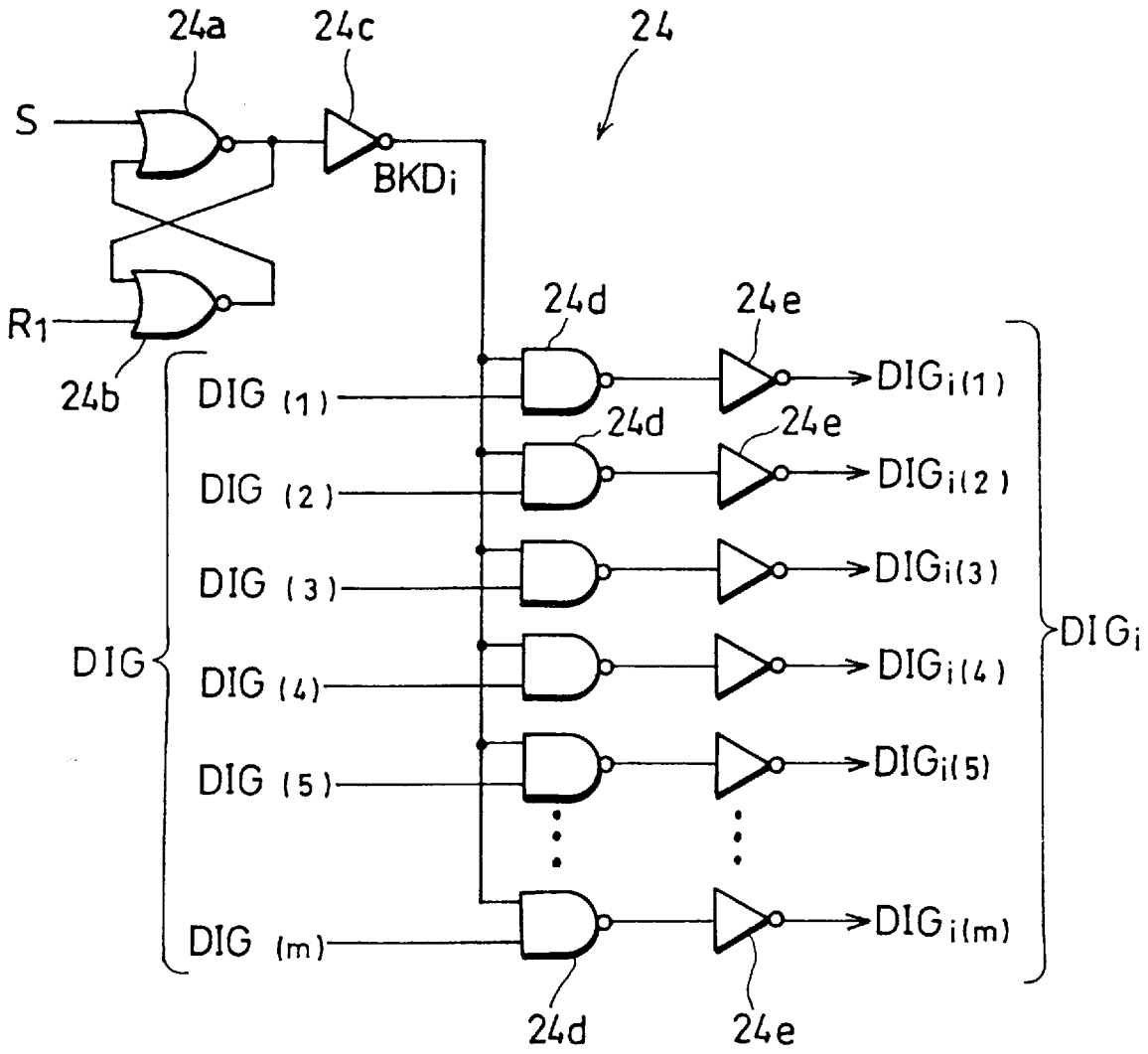
FIG. 7 is a circuit diagram showing an arrangement of a supply circuit in the second data signal output circuit.

As shown in FIG. 7, the supply circuit 24 is provided with NOR gates 24*a* and 24*b*, an inverter 24*c*, NAND gates 24*d*, and inverters 24*e*. NOR gates 24*a* and 24*b* constitute an RS flip-flop. The RS flip-flop and the inverter 24*c* constitute a select circuit.

In the supply circuit 24 of the block $BLK_i$, a pulse signal SRP from the shift register section 21 in the last stage of the preceding block $BLK_{i-1}$ is inputted to the NOR gate 24*a* as a set signal S. As a result, the output of the NOR gate 24*a* becomes a low level, and an activated block select signal $BKD_i$ is outputted from the inverter 24*c* which is provided in the next stage. Then, after the image signals DIG ($DIG_{(1)}$ to $DIG_{(m)}$) and the block select signal $BKD_i$ are subjected to the Logical NAND in the NAND gates 24*d*, image signals $DIG_i$ ($DIG_{i(1)}$ to $DIG_{i(m)}$) are outputted from the NAND gates 24*d* via the respective inverters 24*e*.

On the other hand, in the supply circuit 24 of the block $BLK_i$, a pulse signal SRP from the shift register section 21 in the first stage of the following block $BLK_{i+1}$ is inputted into the NOR gate 24*b* as a reset signal $R_l$ so as to inactivate the block select signal $BKD_i$. Hence, the image signals $DIG_i$ are not outputted from the inverters 24*e*.

Additionally, when the image signals $DIG_i$ are not supplied to the block $BLK_i$, the image signal lines in the block $BLK_i$ are biased to a constant voltage.

In the second data signal output circuit having the above-described arrangement, the image signals $DIG_i$ starts to be supplied to the block $BLK_i$ in accordance with the pulse signal SRP (set signal S) from the shift register section 21 in the last stage of the preceding block $BLK_{i-1}$. It is suspended to supply the image signals $DIG_i$ to the block $BLK_i$ in accordance with the pulse signal SRP (reset signal $R_1$) from the shift register section 21 in the first stage of the following block $BLK_{i+1}$. Therefore, the image signals $DIG_i$ are supplied to the driving sections 22 of the block $BLK_i$ at least during a period in which the image signals $DIG_i$ should be sent to the block $BLK_i$, whereas the image signals $DIG_i$ are not supplied to the driving sections 22 of the block $BLK_i$ during a period other than the above-noted period.

Thus, the second data signal output circuit is arranged so that the block $BLK_i$ generates the block select signal $BKD_i$ inside by utilizing the pulse signal SRP from the shift register section 21. Consequently, it is not required to externally supply the block select signal $BKD_i$, thereby eliminating the need for signal lines through which the block select signals $BKD_1$ are inputted. Thus, it is possible to reduce the power consumption compared with the first data signal output circuit. Further, compared with the first data signal output circuit, the number of input terminals can be reduced, arid a structure of an external system can be simplified in which the second data signal output circuit is provided. Furthermore, if the block select signals $BKD_l$ to $BKD_n$ are set according to optimum pulse signals SRP with respect to the blocks $BLK_1$ to $BLK_n$, it is possible to minimize the number of blocks $BLK_i$ to which the image signals DIG are simultaneously supplied.

In addition, in the second data signal output circuit, as in the first data signal output circuit, the effective load on the signal lines can also be reduced, thereby greatly reducing the power consumption associated with the image signals DIG.

Third Data signal Output Circuit

Figure 8:
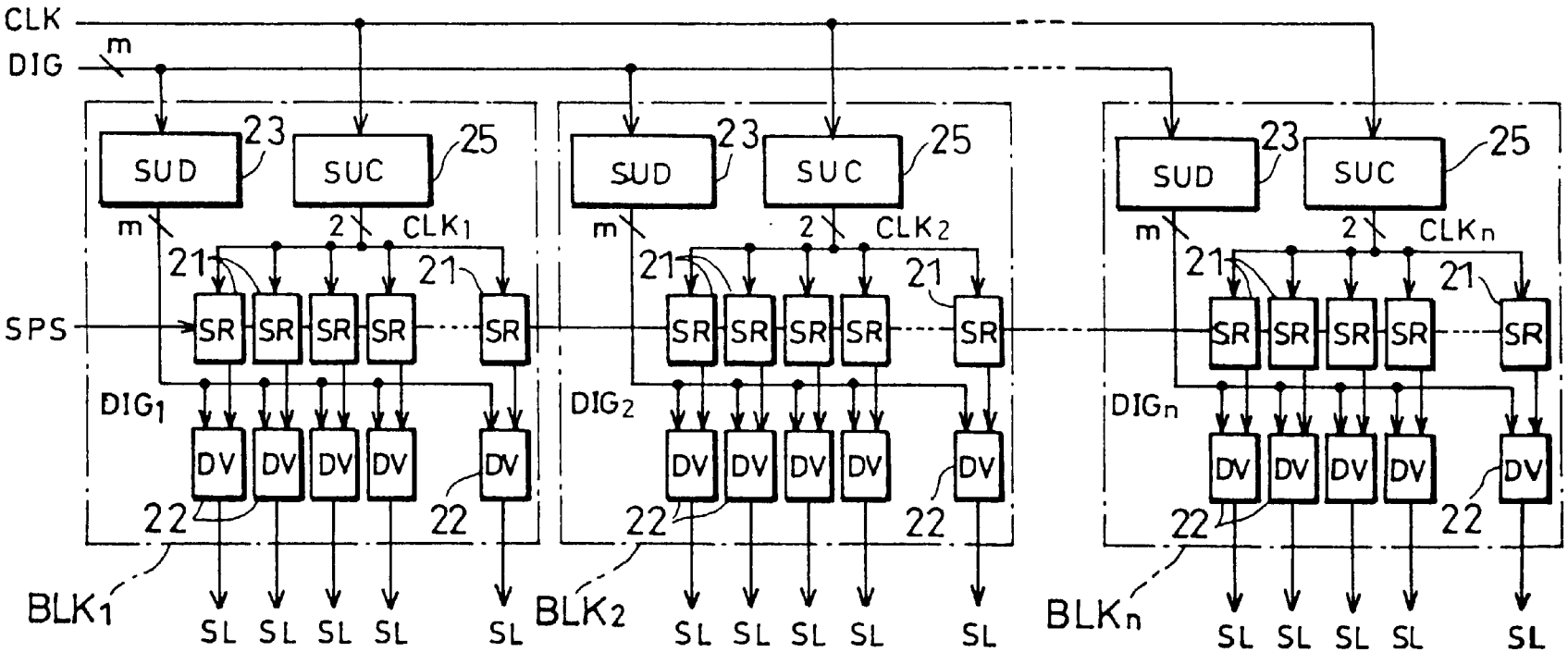
FIG. 8 is a block diagram showing an arrangement of a third data signal output circuit in accordance with one embodiment of the present invention.

As shown in FIG. 8, a third data signal output circuit has the same basic arrangement as the first data signal output circuit except supply circuits (SUC in FIG. 8) 25 which are respectively provided in the blocks $BLK_1$ to $BLK_n$. A supply circuit 25, as a second supply circuit, selectively supplies clock signals CLK and/CLK to the blocks $BLK_l$ to $BLK_n$.

Figure 9:
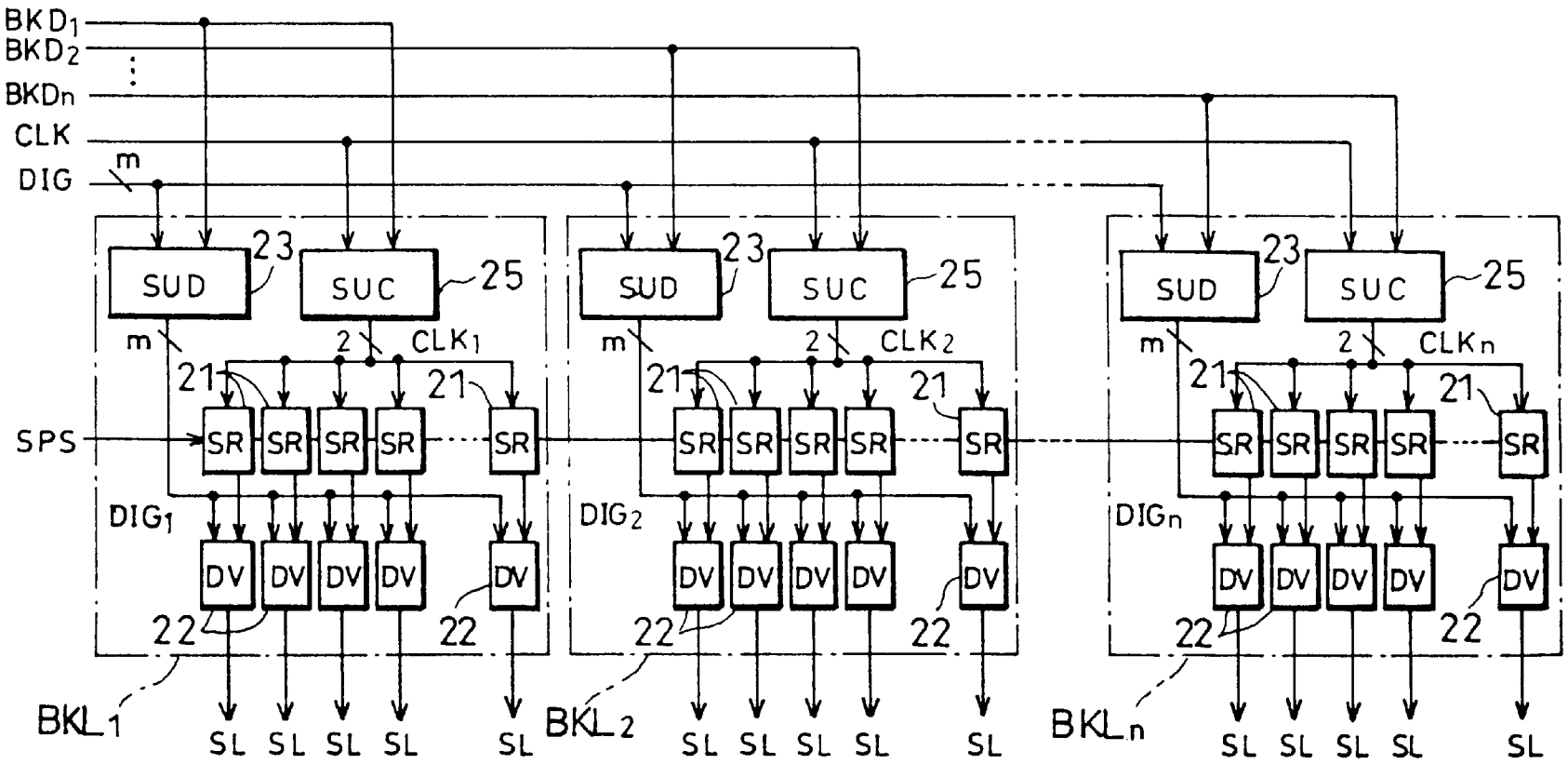
FIG. 9 is a block diagram showing a specific arrangement of the third data signal output circuit.

More specifically, the third data signal output circuit of FIG. 8 is arranged as illustrated in FIG. 9. Here, explanations will be given to a block $BLK_i$ among the blocks $BLK_l$ to $BLK_n$.

The supply circuit 25 of the block $BLK_i$ is controlled by the block select signal $BKD_i$ which is externally inputted so as to supply the clock signal CLK to the shift register sections 21 in the block $BLK_i$ in a predetermined period of time.

Figure 10:
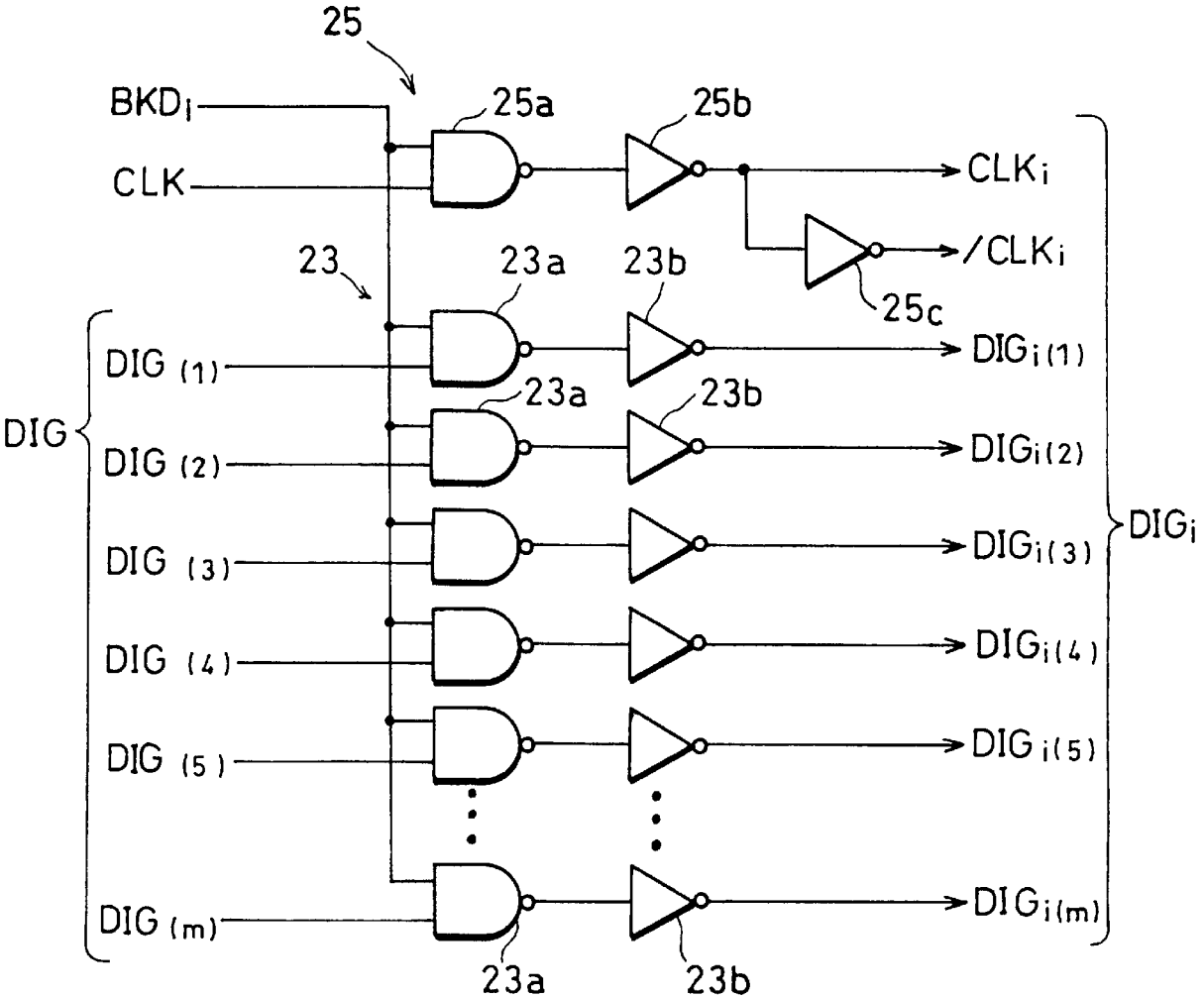
FIG. 10 is a circuit diagram showing an arrangement of a supply circuit in the third data signal output circuit of FIG. 9.

As shown in FIG. 10, the supply circuit 25 is provided with NAND gates 25*a* and inverters 25*b* and 25*c* so that the block select signal $BKD_i$ is supplied both to the supply circuits 23 and 25. In the supply circuit 25 having this arrangement, the clock signal CLK and the block select signal $BKD_i$ are subjected to the logical NAND in the NAND gate 25*a*. Hence, the supply circuit 25 outputs the clock signals $CLK_i$ and/$CLK_i$ when the block select signal $BKD_i$ is activated, whereas does not output the clock signals $CLK_i$ and/$CLK_i$ when the block select signal $BKD_i$ is inactivated.

Here, in the case where the clock signals $CLK_i$ and/$CLK_i$ are not supplied to the block $BLK_i$, the clock signal lines in the block $BLK_i$ are biased to a certain voltage.

Figure 11:
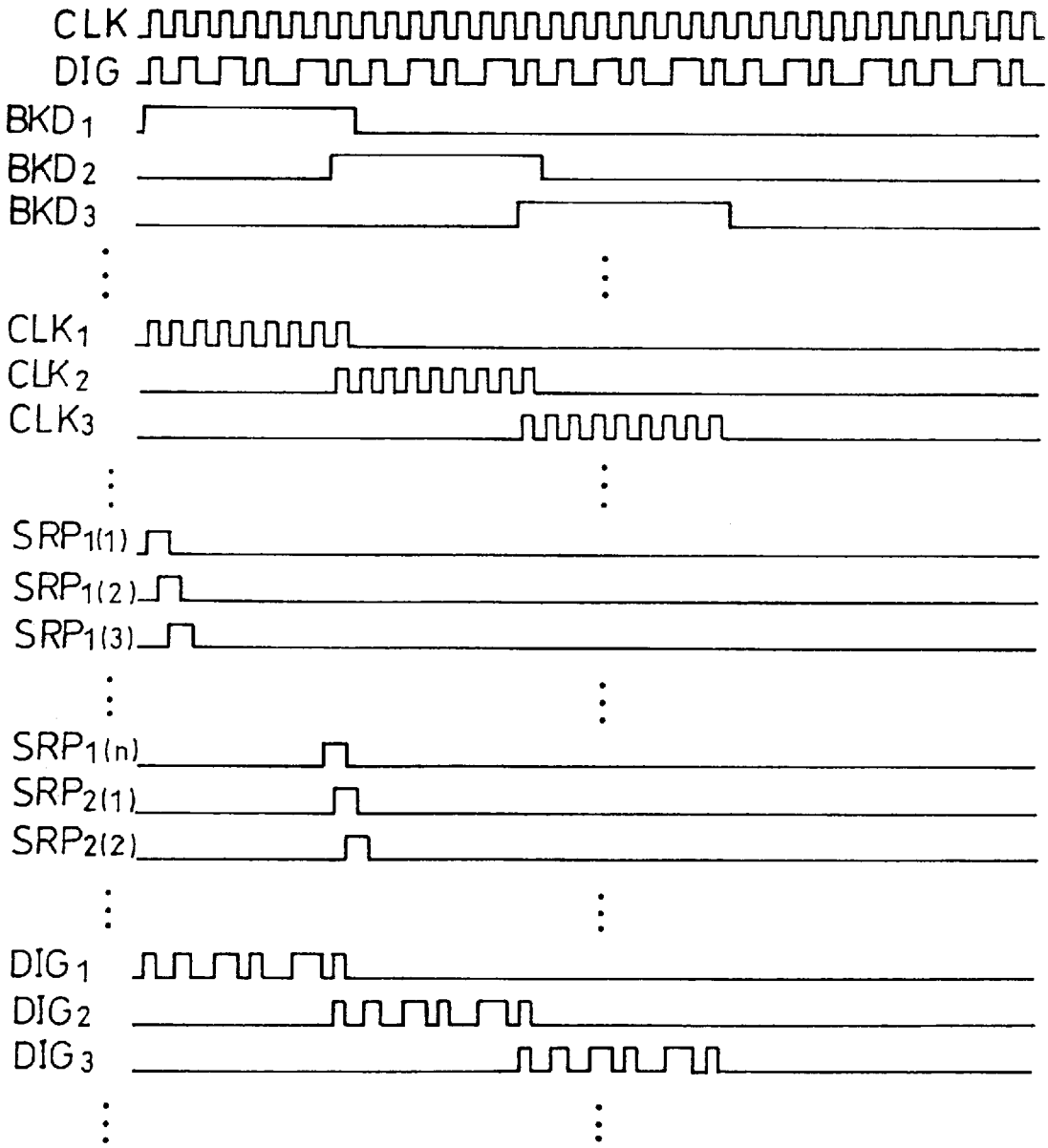
FIG. 11 is a timing chart showing how the third data signal output circuit of FIG. 9 is operated.

The following will explain how the third data signal output circuit having the above arrangement is operated referring to the timing chart of FIG. 11.

In the blocks $BLK_1$ to $BLK_n$, the clock signals $CLK_1$ $CLK_n$ (clock signals/$CLK_i$ are not shown in FIG. 11) are outputted from respective supply circuits 25 during a period of time in which the block select signals $BKD_1$ to $BKD_n$ are activated (high level). Here, the block select signals $BKD_1$ to $BKD_n$ are activated so as to overlap for a predetermined period of time in order to prevent head end and tail end portions of the clock in the clock signals $CLK_1$ to $CLK_n$ from being missing.

The pulse signals $SRP_{l(1)}$ to $SRP_{1(N)}$ are outputted one after another from the shift register sections 21 of the block $BLK_1$in synchronism with the clock signal $CLK_1$. In the same manner, the pulse signals SRP are also outputted from the shift register sections 21 of the blocks $BLK_2$ to $BLK_n$.

On the other hand, as in the first data signal output circuit, the image signals $DIG_i$ are outputted from the supply circuit 23 during a period of time when the block select signal $BKD_i$ is activated. When driving sections 22 receive the image signals $DIG_i$ in synchronism with the pulse signals SRP, the driving sections 22 output gradation voltages as selected according to the image signals $DIG_i$ to the data signal lines SL.

As described, in the third data signal output circuit of FIG. 9, the supply circuits 23 supply the image signals $DIG_1$to $DIG_n$ to the divided blocks of $BLK_l$ to $BLK_n$, and the supply circuits 25 supply the clock signals $CLK_l$ to $CLK_n$. More specifically, in the block $BLK_i$, the third data signal output circuit supplies the image signals $DIG_i$ and the clock signals $CLK_i$ to the block $BLK_i$ according to the block select signal $BKD_i$ which is activated at least (1) during a period of time in which the pulse signals $SRP_i$ are outputted from the shift register sections 21, and (2) during a predetermined period of time before and after the period of time of the above-noted (1). On the other hand, the image signals $DIG_i$ and the clock signals $CLK_i$ are not supplied during a period of time other than those of the above-noted (1) and (2) in which the block select signal $BKD_i$ is not activated.

With this arrangement, it is possible to specify the period of time in which the image signal $DIG_i$ is sent to the driving sections 22 and the period of time in which the clock signal $CLK_i$ is supplied to the shift register sections 21 with respect to each block $BLK_i$. Therefore, only the required image signal $DIG_i$ and the clock signal $CLK_i$ are supplied to the block $BLK_i$. In this manner, the image signal $DIG_i$ and the clock signal $CLK_i$ are selectively supplied to the block $BLK_i$ so as to prevent the clock signal CLK from being supplied to all the blocks $BLK_i$ to $BLK_n$ simultaneously, thereby reducing the effective load on the image signal lines and the clock signal lines. As a result, it is possible to greatly reduce the power consumption associated with the image signal DIG and the clock signal CLK.

Furthermore, if the block select signal $BKD_i$ is shared by the supply circuits 23 and 25, the number of signal lines can be reduced, thereby (1) suppressing an increase in the number of input terminals in the third data signal output circuit and (2) simplifying the structure of an external system in which the third data signal output signal is provided. Moreover, the block select signals $BKD_1$ to $BKD_n$ are appropriately set with respect to the blocks $BLK_1$ to $BLK_n$ so as to minimize the number of blocks $BLK_i$ to which the image signal DIG and the clock signal CLK are simultaneously supplied. Therefore, in the third signal data line output circuit, compared with the second signal data line output circuit, the power consumption can be reduced.

Figure 12:
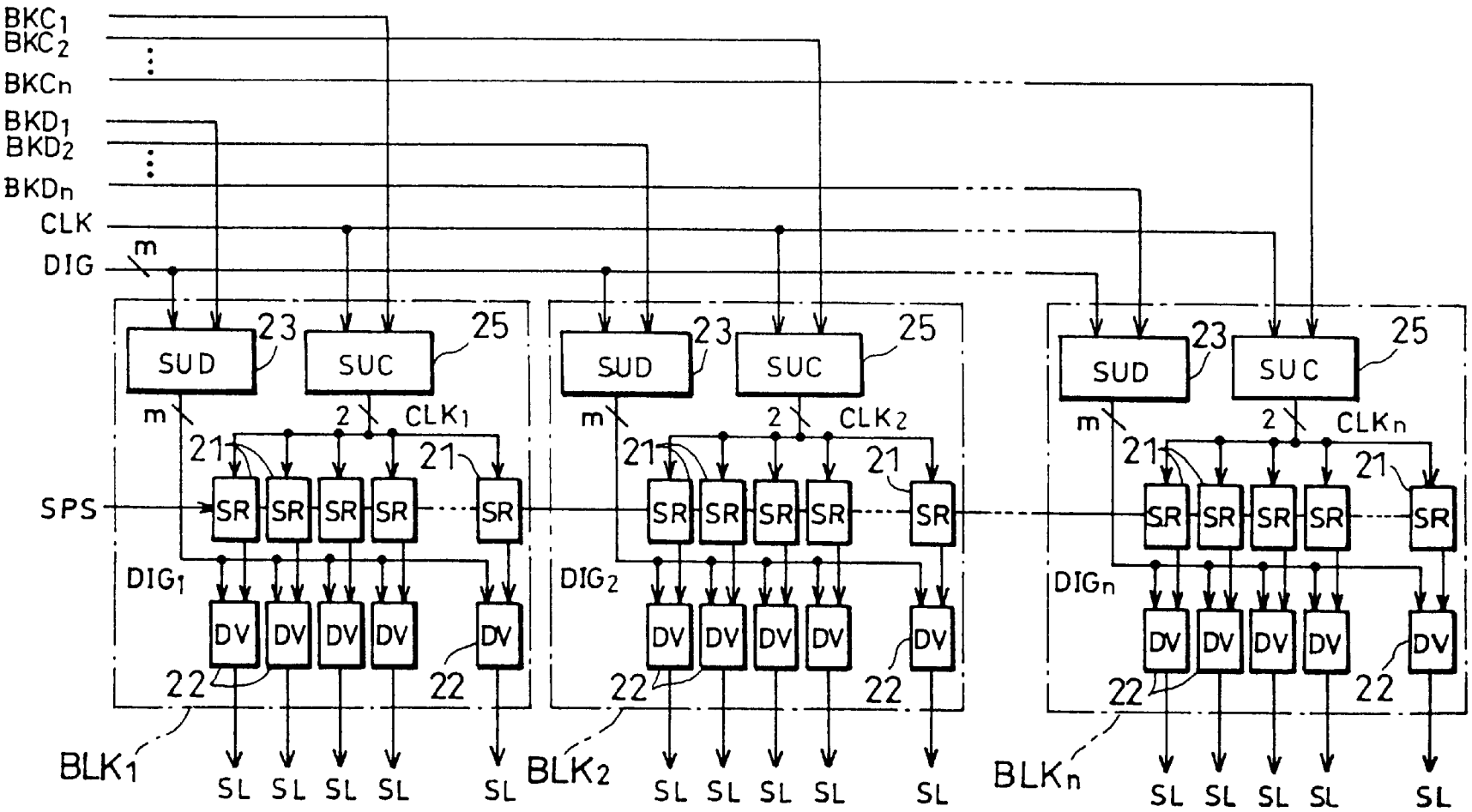
FIG. 12 is a block diagram showing another specific arrangement of the third data signal output circuit.

More specifically, the third data signal output circuit of FIG. 8 can also be arranged as illustrated in FIG. 12. Here, explanations also will be given to a block $BLK_i$ among the blocks $BLK_1$ to $BLK_n$.

The supply circuit 25 of the block $BLK_i$ is controlled by block select signal $BKC_i$ (second block select signals) which is externally inputted in order to supply the clock signal CLK to the shift register sections 21 in the block $BLK_i$ in a predetermined period of time.

Figure 13:
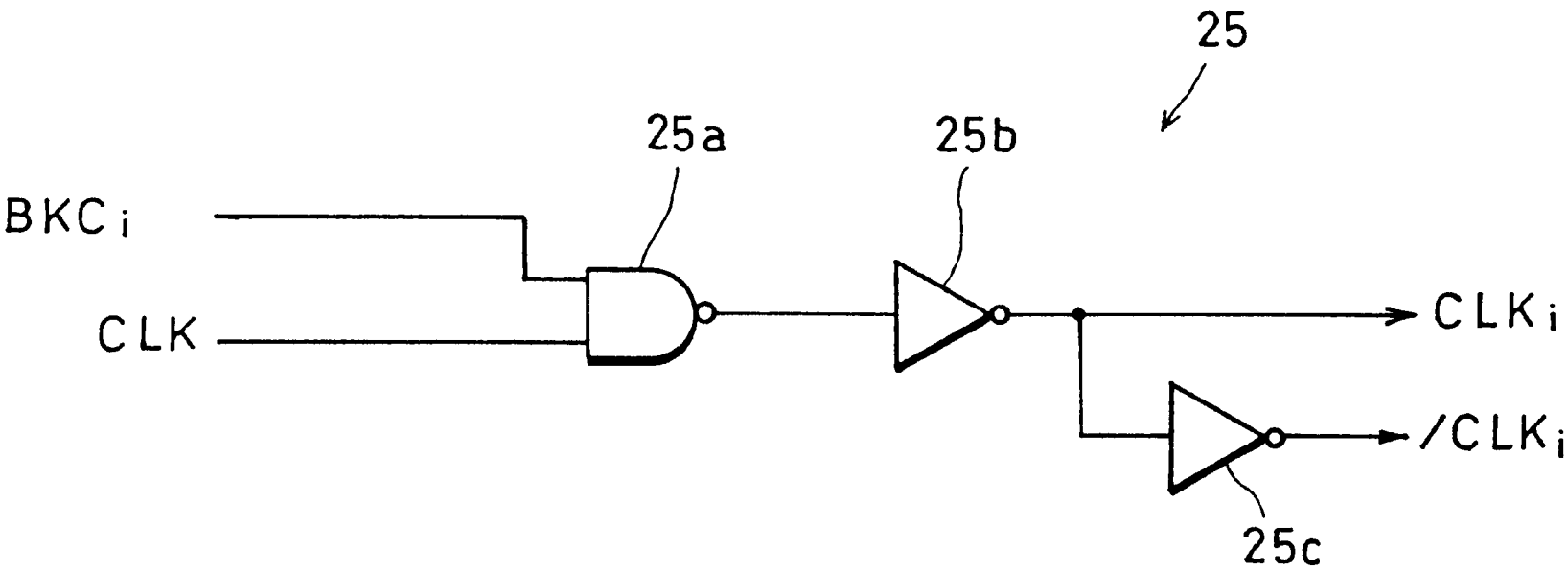
FIG. 13 is a circuit diagram showing an arrangement of a supply circuit in the third data signal output circuit of FIG. 12.

As shown in FIG. 13, although the supply circuit 25 is provided with NAND gates 25*a* and inverters 25*b* and 25*c*, the supply circuit 25 of FIG. 13 differs from that of FIG. 10 in that a block select signal $BKC_i$, instead of the block select signal $BKD_i$, is inputted to the NAND gate 25*a*. Therefore, the supply circuit 25 of FIG. 13 outputs the clock signals $CLK_i$ and/$CLK_i$ when the block select signal $BKC_i$ is activated, whereas the supply circuit 25 of FIG. 13 does not output the clock signals $CLK_i$ and/$CLK_i$ when the block select signal $BKC_i$ is inactivated.

Figure 14:
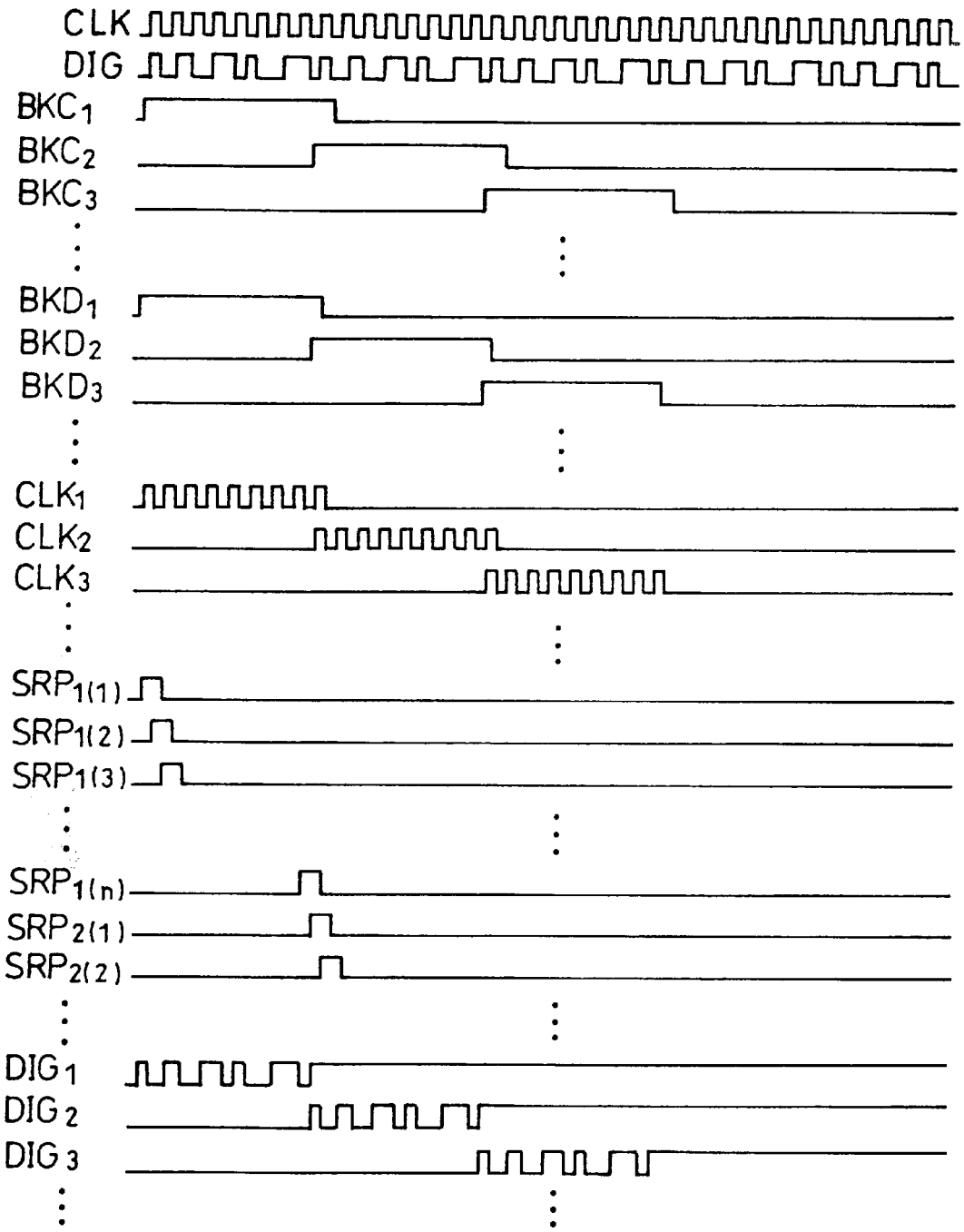
FIG. 14 is a timing chart showing how the third data signal output circuit of FIG. 12 is operated.

The following will explain how the third data signal output circuit having the above arrangement is operated referring to the timing chart of FIG. 14.

In the blocks $BLK_1$ to $BLK_n$, the clock signals $CLK_1$ to $CLK_n$ (clock signals/$CLK_i$ are not shown in FIG. 14) are outputted from respective supply circuits 25 during a period of time in which the block select signals $BKC_1$ to $BKC_n$ are activated (high level). Here, the block select signals $BKC_1$ to $BKC_n$ are activated so as to overlap for a predetermined period of time in order to prevent the head end and the tail end portions of the clock in the clock signals $CLK_l$ to $CLK_n$ from being missing.

The pulse signals $SRP_{1(l)}$ to $SRP_{l(n)}$ are outputted one after another from the shift register sections 21 of the block $BLK_1$in synchronism with the clock signal $CLK_l$. In the same manner, the pulse signals SRP are also outputted from the shift register sections 21 of the blocks $BLK_2$ to $BLK_n$.

On the other hand, the image signals $DIG_i$ are outputted from the supply circuit 23 during a period of time in which the block select signal $BKD_i$ (a first block select signal) is activated, and are sent to driving sections 22 in synchronism with the pulse signals SRP. The driving sections 22 output gradation voltages as selected according to the image signals $DIG_i$ to the data signal lines SL as a display-use data signal (data signal).

As described, in the third data signal output circuit of FIG. 12, the supply circuits 25 supply the clock signals $CLK_1$ to $CLK_n$ to the divided blocks $BLK_1$to $BLK_n$ only in a required minimum period of time. More specifically, in the block $BLK_i$, the third data signal output circuit supplies the clock signals $CLK_i$ to the block $BLK_i$ according to the block select signal $BKC_i$ which is activated at least (1) during a period of time in which the pulse signals $SRP_i$ are outputted from the shift register sections 21, and (2) during a predetermined time before and after the period of time of the above-noted (1). On the other hand, the clock signals $CLK_i$ are not supplied in other periods in which the block select signal $BKC_i$ is not activated.

According to this arrangement, it is possible to specify for each block $BLK_i$ the period of time in which the clock signals $CLK_i$ are supplied to the shift register 21 so as to be independent from the period of time in which the image signals $DIG_i$ are supplied to the driving sections 22. Therefore, only the required clock signals $CLK_i$ are supplied to the block $BLK_i$, thereby making it possible to independently set the optimum period of time in which the image signal DIG and the clock signal CLK are supplied respectively.

As long as the image signal DIG is externally inputted during a period of time in which the pulse signals SRP are output from the shift register sections 21, it is ensured that the image signal DIG is supplied to the block BLK even if the block select signals BKD are activated so as to overlap only for a short period of time. However, if the block select signals BKC and the block select signals BKD are activated for the same period of time, the clock signal CLK cannot ensure the transmitting of the rising and falling of the pulse signals SRP.

In order to solve such a problem, the third data signal output circuit of FIG. 12 is separately provided with the supply circuits 23 and 25 for the image signal DIG and the clock signal CLK respectively such that the supply of the image signal DIG and the clock signal CLK are controlled independently by the block select signal BKC and the block select signal BKD. Therefore, as shown in FIG. 14, the time at which the block select signal $BKC_i$ change from an activated state to an inactivated state is delayed with respect to the time at which the block select signal $BKD_i$ changes from an activated state to an inactivated state so as to supply the clock signals $CLK_i$, for a longer period of time.

In this manner, the supply of the image signal DIG and the clock signal CLK are controlled so as to be optimized. Hence, the power consumption can also be reduced by means of optimizing the supply of the signals.

Additionally, in the third data signal output circuit shown in FIG. 12, as in the third data signal output circuit shown in FIG. 9, the image signal $DIG_i$ and the clock signal $CLK_i$ may be selectively supplied to the block $BLK_i$ so as to reduce the effective load on the image signal lines and the clock signal lines. As a result, the power consumption can be greatly reduced which is associated with the image signal DIG and the clock signal CLK.

Fourth Data Signal Output Circuit

Figure 15:
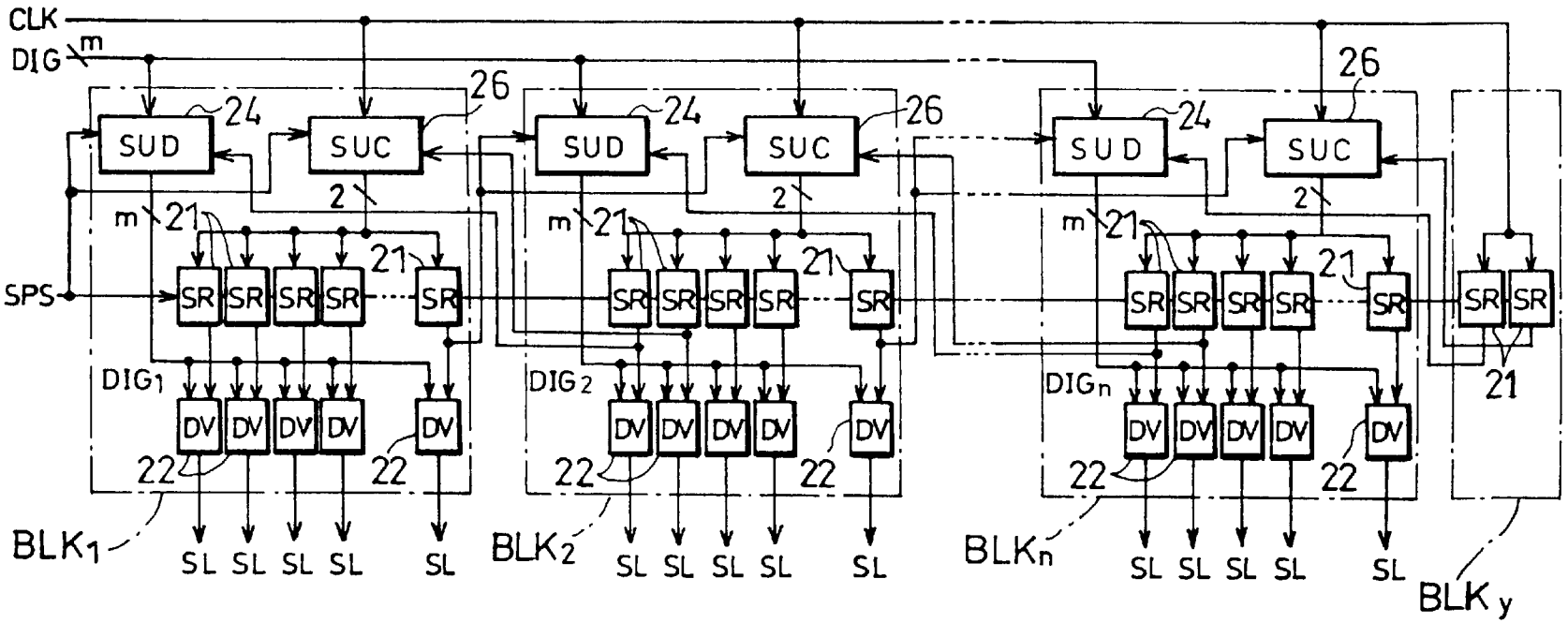
FIG. 15 is a block diagram showing an arrangement of a fourth data signal output circuit in accordance with one embodiment of the present invention.

As shown in FIG. 15, a fourth data signal output circuit is divided into the blocks $BLK_1$ to $BLK_n$ as in the third data signal output circuit. However, the fourth data signal output circuit differs from the third data signal output circuit in that, in the blocks $BLK_1$ to $BLK_n$, the fourth data signal output circuit is provided with supply circuits 24 and 26 which are different from the supply circuits 23 and 25. The fourth data signal output circuit is further provided with a block $BLK_y$. The block $BLK_y$ having two shift register sections 21 is provided in a stage following the block $BLK_n$. The shift register sections 21 of the $BLK_y$ are connected in series to the shift register section 21 in the last stage of the preceding block $BLK_n$, and the shift register sections 21 are supplied with the clock signal CLK.

The pulse signals SRP from the shift register sections 21 in the respective last stages of the blocks $BLK_1$ to $BLK_{n-1}$ are supplied to the supply circuits 24 and 26 of blocks $BLK_2$ to $BLK_n$, respectively provided in the following stages of the blocks $BLK_1$to $BLK_{n-1}$. Further, the pulse signals SRP from the shift register sections 21 in the respective first stages of the blocks $BLK_2$ to $BLK_n$ are supplied to the supply circuits 24 of the blocks $BLK_l$ to $BLK_{n-l}$ respectively provided in the preceding stages of the blocks $BLK_2$ to $BLK_n$. Furthermore, the pulse signals SRP from the shift register sections 21 in the respective second stages of the blocks $BLK_2$ to $BLK_n$ are supplied respectively to the supply circuits 26 of the preceding blocks $BLK_1$ to $BLK_{n-1}$.

Here, the start pulse SPS is supplied to the supply circuits 24 and 26 of the block $BLK_l$, and the pulse signals SRP from the shift register sections 21 in the first and second stages of the block $BLK_y$ are supplied respectively to the supply circuits 24 and 26 of the block $BLK_n$.

Figure 16:
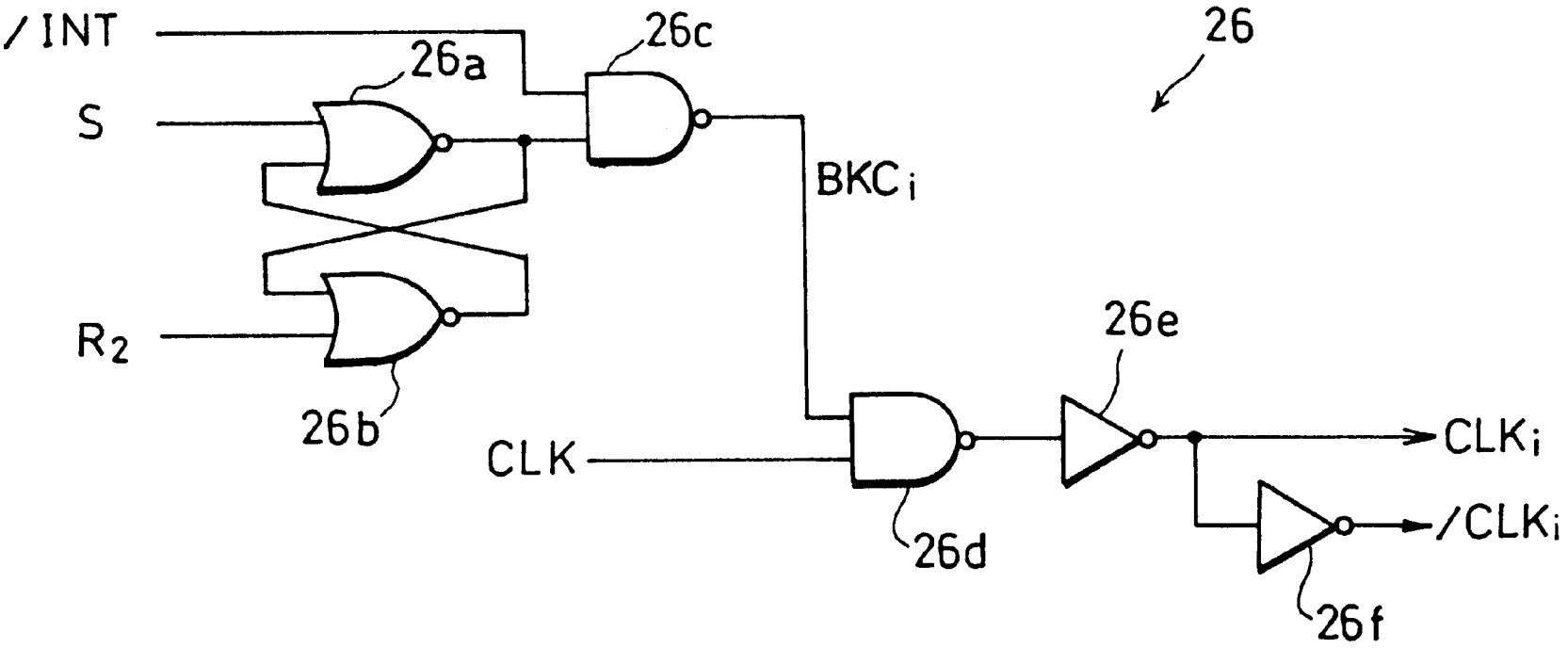
FIG. 16 is a circuit diagram showing an arrangement of a supply circuit in the fourth data signal output circuit.

As shown in FIG. 16, the supply circuit 26 (second supply circuit) is provided with NOR gates 26*a* and 26*b*, NAND gates 26*c* and 26*d*, and inverters 26*e* and 26*f*. The NOR gates 26*a* and 26*b* constitute an RS flip-flop. The RS flip-flop and the NAND gate 26*c* constitute the second supply circuit.

To the NAND gate 26*c*, an initialization signal /INT is externally inputted. The initialization signal /INT, which is inactivated (high level) in a normal state, is activated upon turning on the power. Hence, the NAND gate 26*c* is arranged so that (1) the output signal from the NOR gate 26*a* and (2) the initialization signal /INT are subjected to the logical NAND so as to output the block select signal $BKC_i$ (second block select signal). Further, upon turning on the power, all the block select signals $BKC_i$ are outputted so as to initialize internal nodes, thereby preventing an operational error.

In the case where the initialization signal /INT is not inputted, an inverter is provided instead of the NAND gate 26*c* following the RS flip-flop.

In the supply circuit 26 of the block $BLK_i$, the pulse signal SRP from the shift register section 21 in the last stage of the preceding block $BLK_{i-l}$ is sent to the NOR gate 26*a* as a set signal S. Consequently, the output of the NOR gate 26*a* is inactivated, thereby resulting in that an activated block select signal $BKC_i$ is outputted from the NAND gate 26*c*.

Then, the clock signal $CLK_i$ and the block signal $BKC_i$ are subjected to the logical NAND in the NAND gate 26*d*. As a result, the clock signal $CLK_i$ is outputted from the inverter 26*e* in the following stage of the NAND gate 26*d*. Further, the clock signal $CLK_i$ from the inverter 26*e* is reversed to a clock signal/$CLK_i$ by the inverter 26*f*.

Furthermore, in the supply circuit 26 of the block $BLK_i$ , a pulse signal SRP from the shift register section 21 in the second stage of the following block $BLK_{i+1}$ is inputted to the NOR gate 26*b* as a reset signal $R_2$; thus, the block select signal $BLK_i$ is inactivated with the result that the clock signals $CLK_i$ and/$CLK_i$ are not outputted from the inverters 26*e* and 26*f*.

Here, in the case where the clock signals $CLK_i$ and/$CLK_i$ are not supplied to the block $BLK_i$, the clock signal lines in the block $BLK_i$ are biased to a certain voltage.

The supply circuit 24 of the block $BLK_i$ is arranged as shown in FIG. 7 as in the supply circuit 24 of the second data signal output circuit. In the fourth data signal output circuit, the RS flip-flop (NOR gates 24*a* and 24*b*) and the inverter 24*c* of the supply circuit 24 constitute the first select circuit.

With this arrangement, in the case where the pulse signal SRP from the shift register section 21 in the last stage of the preceding block $BLK_{i-1}$ is sent to the NOR gate 24*a* as a set signal S, an activated block select signal $BKD_i$ is outputted. As a result, the image signals $DIG_i$ are outputted from the supply circuit 24. In contrast, in the case where the pulse signal SRP from the shift register section 21 in the first stage of the following block $BLK_{i+1}$ is sent to the NOR gate 24*b* as a reset signal $R_1$, the image signals $DIG_i$ are not outputted from the inverters 24*e*.

Here, in the case where the image signals $DIG_i$ are not supplied to the block $BLK_i$, the image signal lines in the block $BLK_i$ are biased to a certain voltage.

In the fourth data signal output circuit having the above-described arrangement, as shown in FIG. 14, when a pulse signal $SRP_{i-1(n)}$ ($SRP_{1(n)}$ for example) from the shift register section 21 in the last stage of the preceding block $BLK_{i-1}$ ($BLK_1$for example) is used as a set signal S, the supply of the image signal $DIG_i$ to the block $BLK_i$ starts. Further, when a pulse signal $SRP_{i+1(1)}$ (for example $SRP_{3(n)}$ not shown) from the shift register section 21 in the first stage of the following block $BLK_{i+1}$ is used as a reset signal $R_1$, the supply of the image signal $DIG_i$ to the block $BLK_i$ is suspended. Therefore, the image signal $DIG_i$ is supplied to the driving sections 22 of the block $BLK_i$ at least during a period of time when the image signal $DIG_i$ should be sent to the block $BLK_i$, whereas the image signal $DIG_i$ is not supplied to the driving sections 22 of the block $BLK_i$ during periods of time other than the above-noted period of time.

The pulse signal $SRP_{i-1(n)}$ (set signal S) from the shift register section 21 in the last stage of the preceding block $BLK_{i-1}$ starts the supply of the clock signals $CLK_i$ and/$CLK_i$ to the block $BLK_i$. Further, when the pulse signal $SRP_{1+1(2)}$ (for example $SRP_{3(2)}$ not shown) from the shift register section 21 in the second stage of the following block $BLK_{i+1}$ is used as a reset signal $R_2$, the supply of the clock signals $CLK_i$ and/$CLK_i$ to the block $BLK_i$ is suspended.

Therefore, the image signal $DIG_i$ is supplied to the driving sections 22 of the block $BLK_i$ at least during a period of time when the image signal $DIG_i$ should be sent to the block $BLK_i$, whereas the image signal $DIG_i$ is not supplied to the driving sections 22 of the block $BLK_i$ during periods of time other than the above-noted period of time. Similarly, the clock signals $CLK_i$ and/$CLK_i$ are supplied to the shift register sections 21 of the block $BLK_i$ at least during a period of time when the clock signals $CLK_i$ and/$CLK_i$ should be sent to the block $BLK_i$, whereas the clock signals $CLK_i$ and/$CLK_i$ are not supplied to the shift register sections 21 of the block $BLK_i$ during periods of time other than the above-noted period of time.

With this arrangement, it is possible to specify for each block $BLK_i$ the period of time in which the image signal $DIG_i$ is supplied to the driving sections 22 and the period of time in which the clock signal $CLK_i$ is supplied to the shift register sections 21. Therefore, only the required image signal $DIG_i$ and the clock signal $CLK_i$ are supplied to the block $BLK_i$. In this manner, the image signal $DIG_i$ and the clock signal $CLK_i$ are selectively supplied to the block $BLK_i$ so as to reduce the effective load on the image signal lines and the clock signal lines.

As a result, the power consumption can be greatly reduced which is associated with the image signal DIG and the clock signal CLK.

Moreover, the fourth data signal output circuit generates the block select signals $BKD_i$ and $BKC_i$ in the block $BLK_i$ by utilizing the pulse signals SRP from the shift register sections 21. Consequently, it is not required to externally supply the block select signals $BKD_i$ and $BKC_i$, thereby eliminating the need for providing signal lines through which the block select signals $BKD_i$ and $BKC_i$ are inputted. Therefore, compared with the third data signal output circuit, the number of input terminals can be reduced, and the structure of an external system can be simplified in which the fourth data signal output circuit is provided.

Furthermore, it is possible to specify the period of time in which the clock signal $CLK_i$ is supplied so as to be independent from the period of time in which the image signal $DIG_i$ is supplied, thereby, as in the third data signal output circuit of FIG. 12, making it possible to independently set the optimum period of time in which the image signal DIG and the clock signal CLK are supplied respectively.

Further, if the block select signals $BKD_1$to $BKD_n$ and the block select signals $BKC_1$ to $BKC_n$ are set according to respective optimum pulse signals SRP with respect to the blocks $BLK_1$, to $BLK_n$, it is possible to minimize the number of blocks $BLK_i$ to which the image signal DIG and the clock signal CLK are simultaneously supplied. Therefore, the signal supply can be optimized in this manner so as to reduce the power consumption.

Fifth Data Signal Output Circuit

Figure 17:
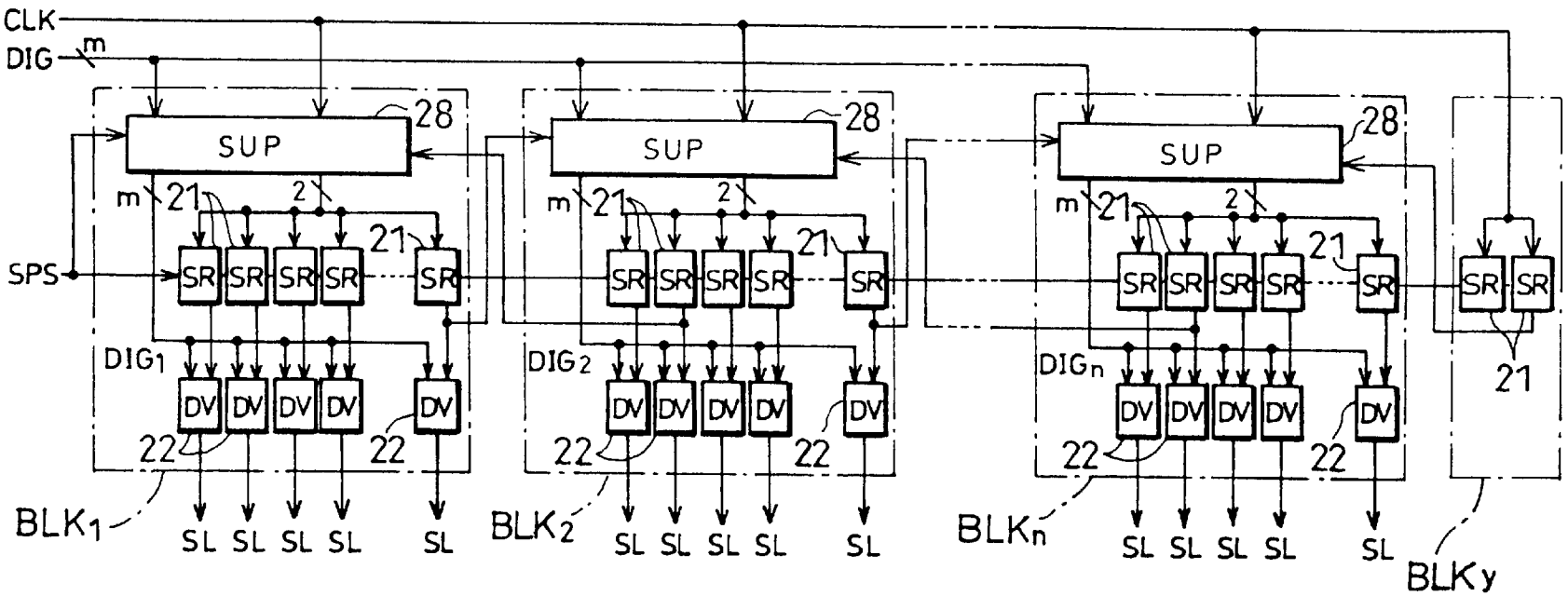
FIG. 17 is a block diagram showing an arrangement of a fifth data signal output circuit in accordance with one embodiment of the present invention.

As shown in FIG. 17, a fifth data signal output circuit is divided into the blocks $BLK_1$ to $BLK_n$, and is provided with the block $BLK_y$ as in the fourth data signal output circuit. However, the fifth data signal output circuit differs from the fourth data signal output circuit in that the blocks $BLK_1$, to $BLK_n$ are provided with a supply circuit 28 which is different from the supply circuits 24 and 26, and the supply circuit 28 constitutes the first and second supply circuits.

The respective pulse signals SRP from the shift register sections 21 in the last stages of the blocks $BLK_l$ to $BLK_{n-1}$ are supplied to the supply circuits 28 of the following blocks $BLK_2$ to $BLK_n$ respectively. Further, the respective pulse signals SRP from the shift register sections 21 in the second stages of the blocks $BLK_2$to $BLK_n$ are supplied to the supply circuits 28 of the preceding blocks $BLK_1$ to $BLK_{n-1}$ respectively.

Further, the start pulse SRP is supplied to the supply circuit 28 of the block $BLK_1$. Also, the pulse signal SRP from the shift register section 21 in the second stages of the block $BLK_y$ is supplied to the supply circuit 28 of the block $BLK_n$.

Figure 18:
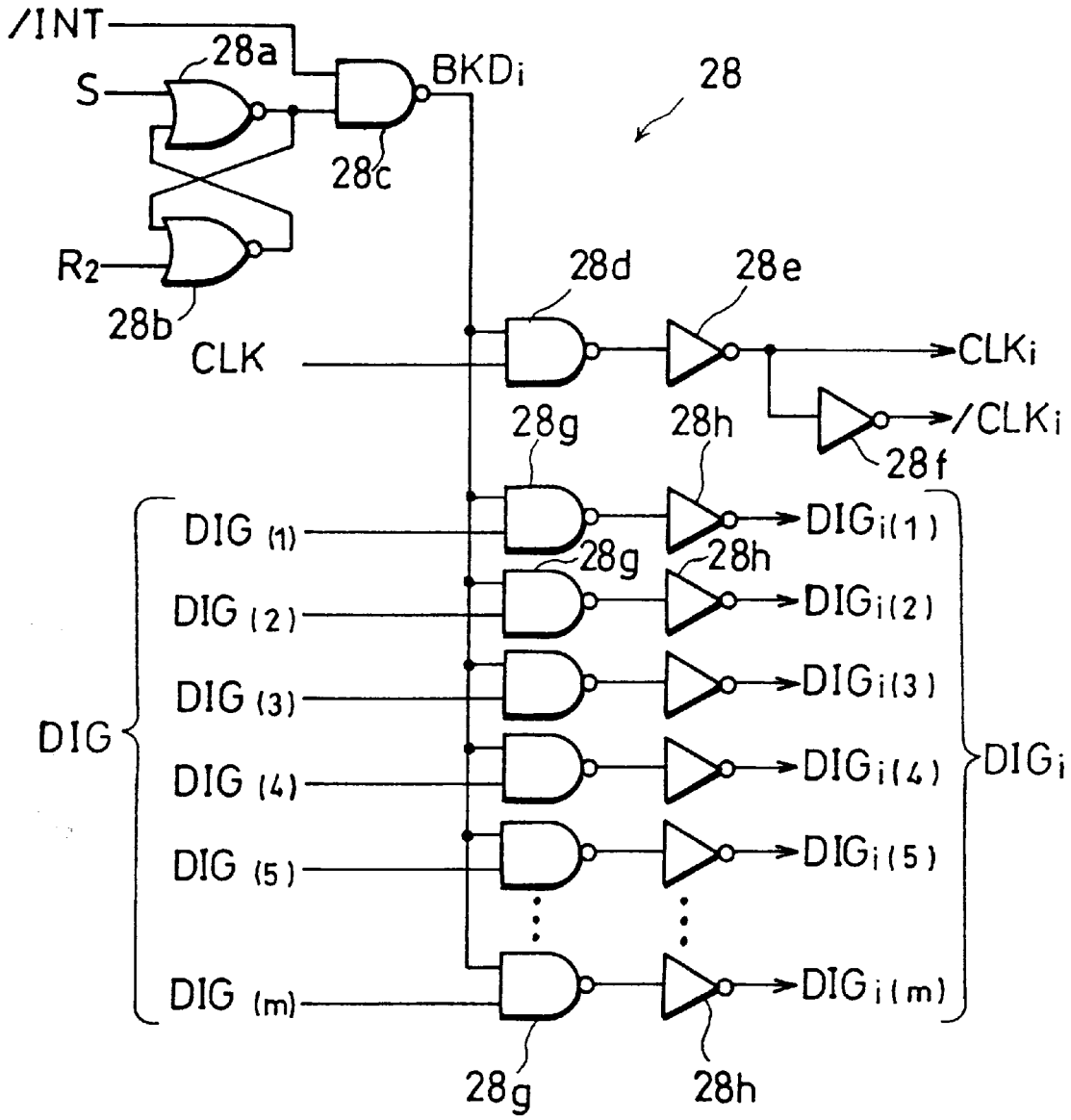
FIG. 18 is a circuit diagram showing an arrangement of a supply circuit in the fifth data signal output circuit.

As shown in FIG. 18, the supply circuit 28 is provided with NOR gates 28*a* and 28*b*, NAND gates 28*c* and 28*d*, inverters 28*e* and 28*f*, NAND gates 28*g*, and inverters 28*h*. The NOR gates 28*a* and 28*b* constitute an RS flip-flop. The RS flip-flop and the NAND gate 28*c* constitute a select circuit.

To the NAND gate 28*c*, the initialization signal /INT is externally inputted. Hence, the NAND gate 28*c* is arranged so that (1) the output signal from the NOR gate 28*a* and (2) the initialization signal /INT are subjected to the logical NAND so as to output the block select signal $BKD_i$. Further, upon turning on the power, as described, all the block select signals $BKD_i$ are outputted so as to prevent an operational error.

In addition, in the case where the initialization signal /INT is not inputted, an inverter is provided instead of the NAND gate 28*c* in the following stage of the RS flip-flop.

In the supply circuit 28 of the block $BLK_i$, the pulse signal SRP from the shift register section 21 in the last stage of the preceding block $BLK_{i-1}$ is sent to the NOR gate 28*a* as a set signal S. Consequently, the output of the NOR gate 28*a* is inactivated, thereby resulting in that an activated block select signal $BKD_i$ is outputted from the NAND gate 28*c*.

Then, the clock signal CLK and the block select signal $BKD_i$ are subjected to the logical NAND in the NAND gate 28*d*, and an output signal from the NAND gate 28*d* is reversed by the inverter 28*e* so that the clock signal $CLK_i$ is outputted. Also, an output signal from the inverter 28*e* is reversed by the inverter 28*f*, and the clock signal/$CLK_i$ is outputted. Further, bit signals $DIG_{(1)}$ to $DIG_{(m)}$ constituting the image signals DIG and the block select signal $BKD_i$ are subjected to the logical NAND in the NAND gates 28*g*, and respective output signals from the NAND gates 28*g* are reversed by the inverters 28*h* so that the image signals $DIG_i$ ($DIG_{i(1)}$ to $DIG_{i(m)}$) are outputted.

Similarly, in the supply circuit 28 of the block $BLK_i$, a pulse signal SRP from the shift register section 21 in the second stage of the following block $BLK_{i+1}$ is inputted to the NOR gate 28*b* as a reset signal $R_2$. Consequently, the block select signal $BKD_i$ is inactivated, thereby resulting in that the clock signals $CLK_i$ and/$CLK_i$ and the image signal $DIG_i$ are not outputted from (1) the inverters 28*e* and 28*f* and (2) the inverters 28*h* respectively.

Here, in the case where the image signals $DIG_i$ are not supplied to the block $BLK_i$, the image signal lines in the block $BLK_i$ are biased to a certain voltage. Also, in the case where the clock signal $CLK_i$ is not supplied to the block $BLK_i$, the clock signal lines in the block $BLK_i$ are biased to a certain voltage.

In the fifth data signal output circuit having the above-described arrangement, as shown in FIG. 11, when the pulse signal $SRP_{i-1(n)}$ ($SRP_{1(n)}$ for example) from the shift register section 21 in the last stage of the preceding block $BLK_{i-1}$ is used as a set signal S, the supply of the image signal $DIG_i$ and the clock signal $CLK_i$ and/$CLK_i$ to the block $BLK_i$ starts. Similarly, when the pulse signal $SRP_{i+l(2)}$ ($SRP_{3(2)}$ not shown) from the shift register section 21 in the second stage of the following block $BLK_{i+1}$ is used as a reset signal $R_2$, the supply of the image signal $DIG_i$ and the clock signals $CLK_i$ and/$CLK_i$ to the block $BLK_i$ is suspended.

Therefore, the image signal $DIG_i$ is supplied to the driving sections 22 of the block $BLK_i$ at least during a period of time when the image signal $DIG_i$ should be sent to the block $BLK_i$, whereas the image signal $DIG_i$ is not supplied to the driving sections 22 of the block $BLK_i$ during periods of time other than the above-noted period of time. Similarly, the clock signals CLK and/$CLK_i$ are supplied to the shift register sections 21 of the block $BLK_i$ at least during a period of time when the clock signals $CLK_i$ and/$CLK_i$ should be sent to the block $BLK_i$, whereas the clock signals $CLK_i$ and/$CLK_i$ are not supplied to the shift register sections 21 of the block $BLK_i$ during periods of time other than the above-noted period of time.

With this arrangement, it is possible to specify for each block $BLK_i$ the period of time in which the image signal $DIG_i$ is supplied to the driving sections 22 and the period of time in which the clock signal $CLK_i$ is supplied to the shift register sections 21. Therefore, only the required image signal $DIG_i$ and the clock signal $CLK_i$ are supplied to the block $BLK_i$. In this manner, the image signal $DIG_i$ and the clock signal $CLK_i$ are selectively supplied to the block $BLK_i$ so as to reduce the effective load on the image signal lines and the clock signal lines. As a result, the power consumption can be greatly reduced which is associated with the image signal DIG and the clock signal CLK.

Moreover, the fifth data signal output circuit generates the block select signal $BKD_i$ in the block $BLK_i$ by utilizing the pulse signal SRP from the shift register section 21. Consequently, it is not required to externally supply the block select signal $BKD_i$, thereby eliminating the need for providing signal lines through which the block select signals $BKD_i$ are inputted. Therefore, as in the fourth data signal output circuit, the number of input terminals can be reduced, and the structure of an external system can be simplified.

Furthermore, in the supply circuit 28, the block select signals $BKD_i$ control the supply of the image signal DIG and the clock signal CLK. Thus, in the supply circuit 28, the select circuit composed of the NOR gates 28*a* and 28*b*, and the NAND gate 28*c* is shared by the supply section of the image signal DIG and that of the clock signal CLK. For this reason, in the fifth data signal output circuit, the supply of the image signal DIG and the clock signal CLK cannot be controlled independently as in the fourth data signal output circuit. Nonetheless, the arrangement of the supply circuit 28 can be simplified, thereby, compared with the fourth data signal output circuit, reducing the scale of the circuit and the power consumption.

Further, if the block select signals $BKD_i$ to $BKD_n$ are set according to optimum pulse signals SRP with respect to the blocks $BLK_1$ to $BLK_n$, it is possible to minimize the number of blocks $BLK_i$ to which the image signal DIG and the clock signal CLK are simultaneously supplied.

The following will explain another embodiment of the present invention referring to FIG. 19 through FIG. 26. The following explanation deal with a first through third liquid crystal display device as examples of an image display device in accordance with the present embodiment.

Figure 19:
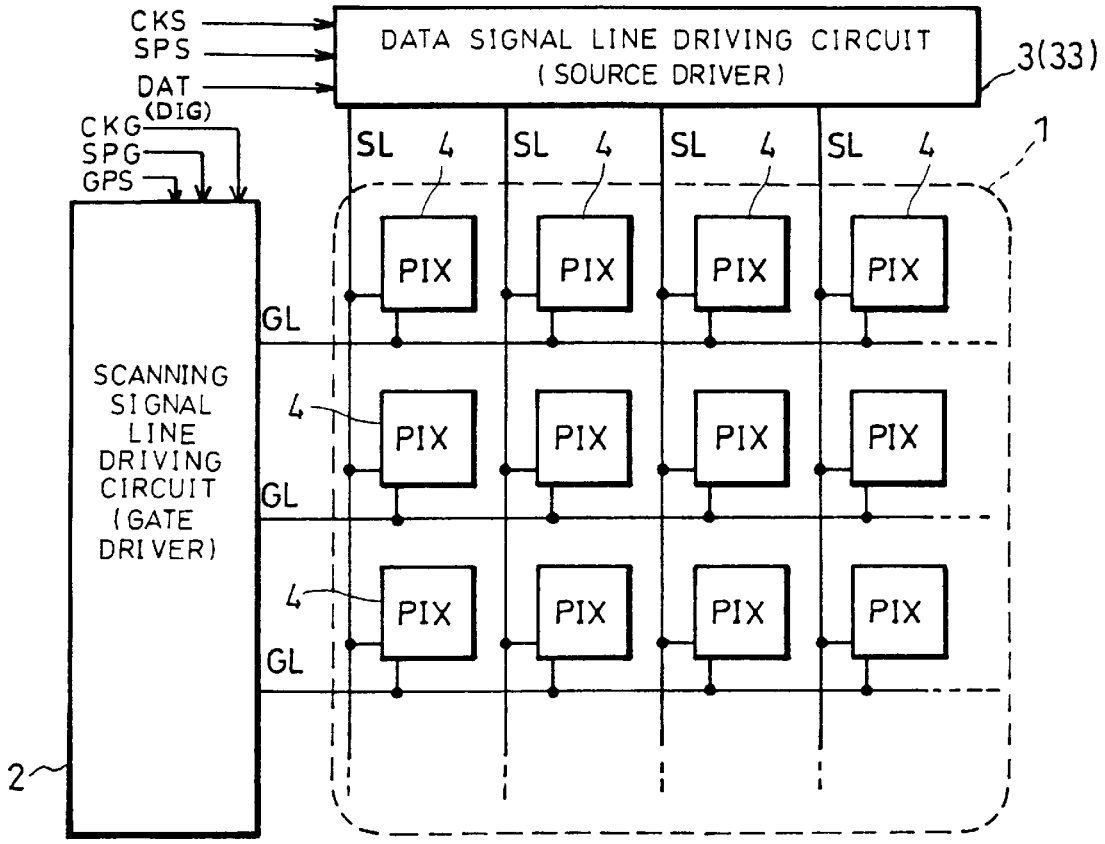
FIG. 19 is a block diagram showing an arrangement which is common to both a first liquid crystal display device in accordance with another embodiment of the present invention and a conventional liquid crystal display device.

As shown in FIG. 19, a first liquid crystal display device is composed of a pixel array 1, a scanning signal line driving circuit (referred to as gate driver hereinafter) 2, and a data signal line driving circuit (referred to as source driver hereinafter) 33. The pixel array 1 includes a number of scanning signal lines GL and a number of data signal lines SL which cross each other. In each area enclosed by adjacent two scanning lines GL and adjacent two data signal lines SL, pixels (indicated by PIX in FIG. 19: 4 are arranged in a matrix.

The source driver 33, as a data signal output circuit, makes a sampling of an image signal DIG which has been inputted in synchronism with a timing signal such as a clock signal CKS, and outputs to the respective data signal lines SL gradation display-use data corresponding to the image signal DIG thus sampled. The gate driver 2, as a writing control circuit, selects the scanning signal lines GL one after another in synchronism with a timing signal such as a clock signal CKG, and controls the opening and closing of the pixel transistors SW provided one by one in each pixel 4. With this arrangement, the gradation display-use data (gradation voltage) corresponding to the image signal which have been outputted to each data signal line SL is written into each pixel 4 and latched therein.

Figure 20:
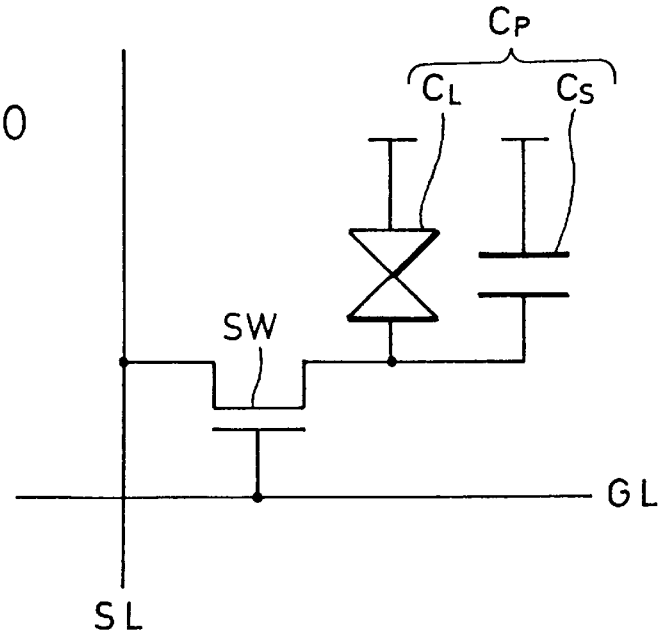
FIG. 20 is a circuit diagram showing an arrangement of a pixel of the first liquid crystal display device.

As shown in FIG. 20, the pixel 4 is provided with a pixel transistor SW, which is a switching element, and pixel capacitor $C_P$ including liquid crystal capacitor $C_L$ and storage capacitor $C_S$ which is supplied as required. As illustrated in FIG. 20, (1) the data signal line (source line) SL and one of the electrodes of the pixel capacitor $C_P$ are connected to each other via the source and the drain of the pixel transistor SW, (2) the gate of the pixel transistor SW made of a field effect transistor is connected to the scanning signal line (gate line) GL, and (3) the other electrode of the pixel capacitor $C_P$ is connected to a common electrode (not shown) which is common to all the pixels 4. In the pixel 4 having the above arrangement, in the case where a voltage (gradation voltage) is applied to the liquid crystal capacitor $C_L$ the transmissivity or the reflectance of the liquid crystal is modulated, and an image corresponding to the image signal DIG is displayed on the pixel arrays 1.

Additionally, the common electrode is provided so as to face a pixel electrode (not shown) of each pixel 4 via a liquid crystal layer.

In an image display device such as the liquid crystal display device, it is effective to reduce the power consumed by a driving circuit in order to reduce the power consumption. For this purpose, the source driver 33 is composed of any one of the aforementioned first through fifth data signal output circuit.

As is described above, the power consumption associated with the image signal and the clock signal is reduced in the data signal output circuits, thereby realizing an image display device with low power consumption. Further, in the source driver 33, as described, the digital image signal DIG is not supplied to all the blocks simultaneously, thereby reducing the effective load on the signal lines which supply the image signal DIG. Moreover, if the source driver 33 is composed of any one of the third through fifth data signal output circuits, it is also possible to reduce the effective load on the signal lines which supply the clock signal CLK.

In this manner, the power consumption of the source driver 33 can be greatly reduced which in turn saves the power consumption of the first liquid crystal display device. The effect becomes especially evident when the image signal DIG is of multiple gradations, since the number of signal lines for supplying the image signal DIG increases accordingly.

Second Liquid Crystal Display Device

Figure 21:
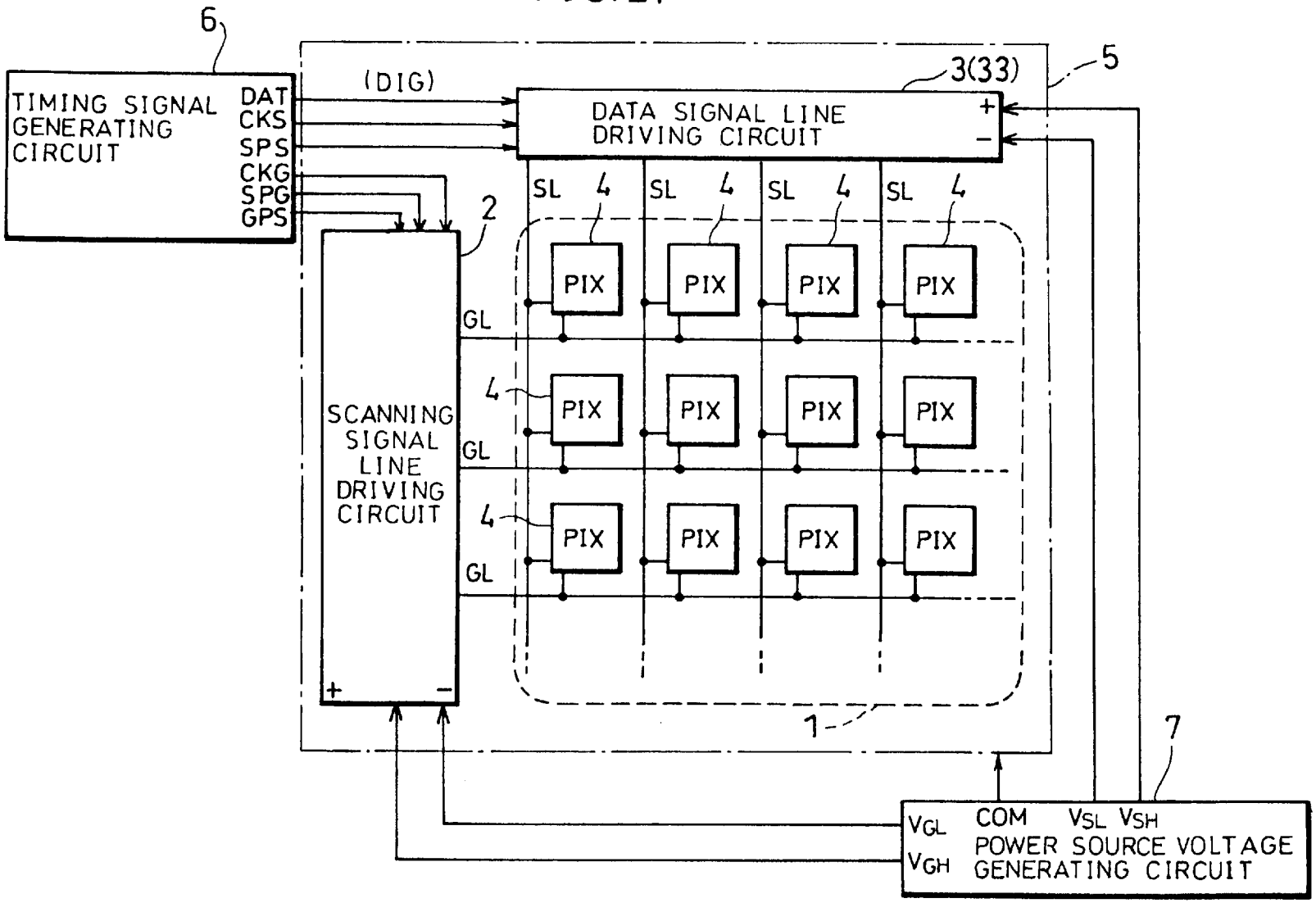
FIG. 21 is a block diagram showing an arrangement which is common to both a second liquid crystal display device in accordance with another embodiment of the present invention and a conventional liquid crystal display device.

As shown in FIG. 21, a second liquid crystal display device is provided with a pixel array 1, a gate driver 2, and a source driver 33, as in the first liquid crystal display device. The second liquid crystal display device is further provided with a timing signal generating circuit (referred to as timing circuit hereinafter) 6 and a power source voltage generating circuit (referred to as power source circuit) 7.

According to the second liquid crystal display device, the gate driver 2 and the source driver 33, together with the pixel array 1, are provided on an insulating substrate, for example, a glass substrate 5. As such an insulating substrate (substrate), a sapphire substrate, a quartz substrate, non-alkali glass, and other materials are widely adopted. As pixel transistors SW, a thin film transistor is adopted. The gate driver 2 and the source driver 33 are realized by the thin film transistor.

The timing circuit 6 outputs to the gate driver 2 a timing signals such as a clock signal CKG, a start pulse SPG, and a synchronous signal GPS. The timing circuit 6 also outputs to the source driver 33 a timing signals such as the image signal DIG, a clock signal CKS (clock signal CLK), and a start pulse SPS.

The power source circuit 7 outputs to (1) the gate driver 2 a power source voltage $V_{GH}$ on the high-potential side and a power source voltage $V_{GL}$ on the low-potential side, to (2) the source driver 33 a power source voltage $V_{SH}$ on the high-potential side and a power source voltage $V_{SL}$ on the low-potential side, and to (3) the common electrode a common potential COM. The power source circuit 7 further outputs a plurality of gradation voltages which will be mentioned later.

In the second liquid crystal display device having the above arrangement, since the source driver 33 is realized by any one of the first through fifth data signal output circuits, as in the first liquid crystal display device, the power consumption can be reduced.

Figure 22:
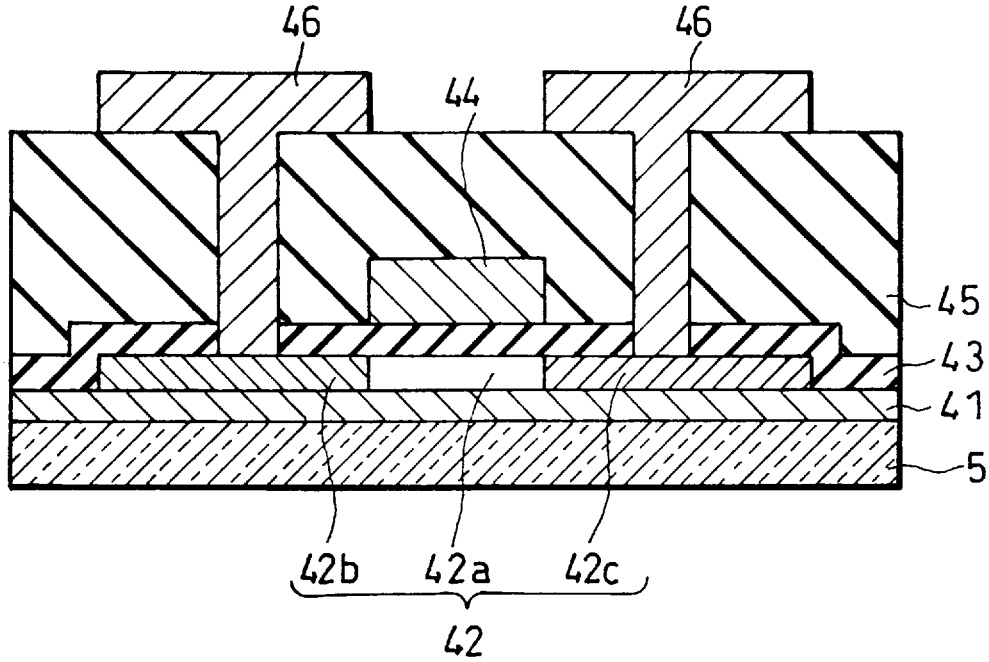
FIG. 22 is a cross sectional view showing a structure of a thin film transistor employed in the second liquid crystal display device.
Figure 23A:
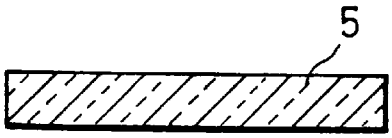
FIG. 23(*a*) through FIG. 23(*k*) are cross sectional views showing structures in the manufacturing steps of the thin film transistor of FIG. 22.
Figure 23B:
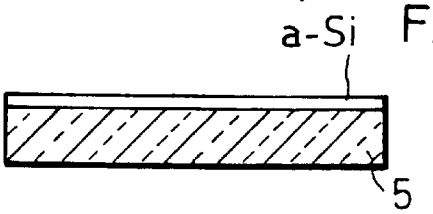
Figure 23C:
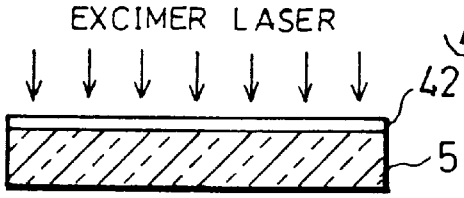
Figure 23D:
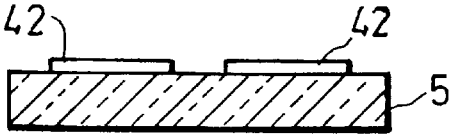
Figure 23E:
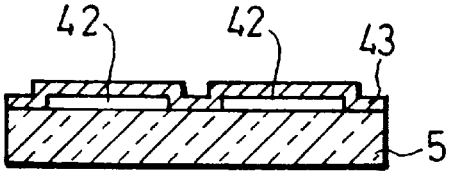
Figure 23F:
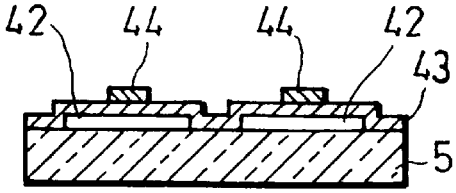
Figure 23G:
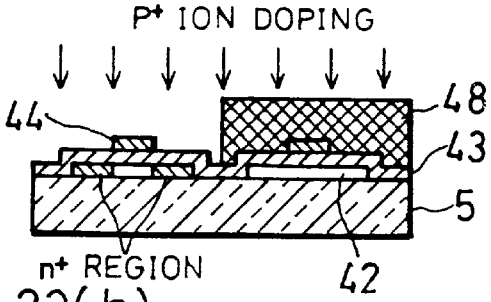
Figure 23H:
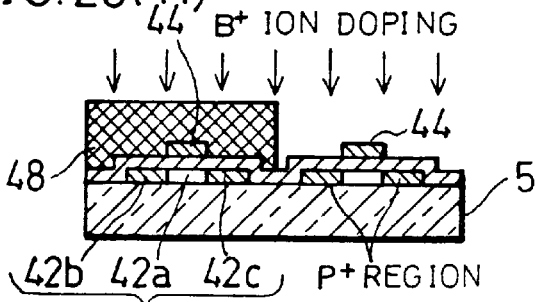
Figure 23I:
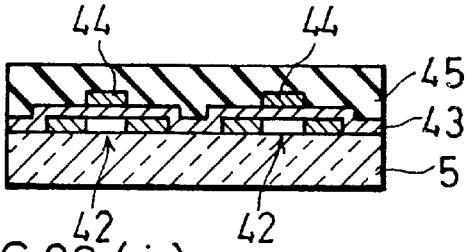
Figure 23J:
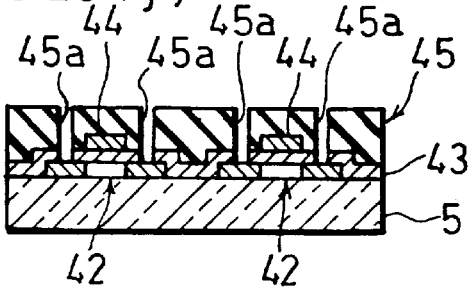
Figure 23K:
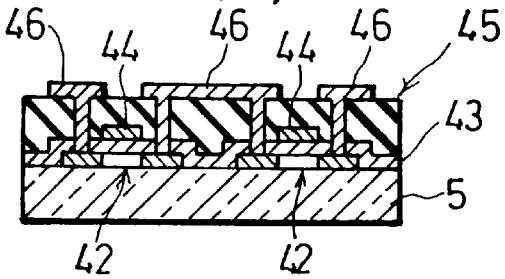

Here, the thin film transistor is a polycrystal silicon thin film transistor having a structure illustrated in FIG. 22. In this structure, an anti-contamination silicon oxide film 41 is deposited on the glass substrate 5, and a field effect transistor is formed thereon.

The thin film transistor is composed of a polycrystal silicon thin film 42 provided on the silicon oxide film 41. The thin film transistor is also composed of a gate insulating film 43, a gate electrode 44, an interlayer insulating film 45, and metal wires 46, which are provided on the polycrystal silicon thin film 42 as shown in FIG. 22. The polycrystal silicon thin film 42 includes a channel region 42*a*, a source region 42*b*, and a drain region 42*c*.

With this arrangement, from outside the glass substrate 5, the timing signals and the image signals from the timing circuit 6, and various voltages from the power source circuit 7 are merely inputted. Thus, in the second liquid crystal display device, less number of input terminals are required for the glass substrate 5 compared with a liquid crystal display device in which are external IC is used as a driver. As a result, it is possible to reduce (1) the cost for mounting components associated with the input terminals on the glass substrate 5 and (2) the occurrence of defects due to inappropriate mounting.

In general, the element size of a thin film transistor is large and the driving voltage tends to be high. Therefore, a circuit composed of such a thin film transistor increases a load on the image signal lines and the clock signal lines in the source driver, thereby causing the power consumption to increase. For this reason, in the case where a circuit, such as an amplifier, which consumes a lot of power, is not provided in the source driver 33, the power consumption associated with the image signal DIG and the clock signal CKS etc. constitute a large proportion of the power consumption of the source driver 33.

However, in the liquid crystal display device of the present embodiment, since the source driver 33 is realized by any one of the first through fifth data signal output circuits, the effective load on the signal lines can be reduced. Therefore, even if the transistors constituting the source driver 33 and the pixel array 1 are the thin film transistor formed on the same single glass substrate 5, as in the first liquid crystal display device, the effective load on the signal lines can be reduced. Thus, even in the source driver adopting the thin film transistor in which the power consumption cannot be reduced drastically, the power consumption can be reduced with ease.

In addition, in the liquid crystal display device of the present embodiment, the transistor is not limited to that shown in FIG. 22, but other transistors such as a monocrystal silicon thin film transistor, an amorphous silicon thin film transistor, and a thin film transistor made of other materials may be used.

For example, the thin film transistor can be manufactured in the following processes.

(1) An amorphous silicon thin film a-Si is deposited on the class substrate 5 of FIG. 23(*a*) (see FIG. 23 (*b*)) , (2) a polycrystal silicon thin film 42 is formed by irradiation of excimer laser on the amorphous silicon thin film a-Si (see FIG. 23(*c*)) , (3) the polycrystal silicon thin film 42 is patterned in a desired shape (see FIG. 23(*d*)), (4) a gate insulating film 43 made of silicon dioxide is formed thereon (see FIG. 23(*e*)).

(5) A gate electrode 44 is formed with aluminum etc. (see FIG. 23(*f*)), (6) impurity (phosphorous for the n-type region, and arsenic for the p-type region) is injected into regions to be a source region 42*b* and a drain region 42*c* of each polycrystal silicon thin film 42 (see FIGS. 23(*g*) (*h*)). When injecting the impurity into the n-type region, the p-type region is masked by resist 48 (see FIG. 23(*g*)), and when injecting the impurity into the p-type region, the n-type region is masked by the resist 48 (see FIG. 23(*h*)).

(7) An interlayer insulating film 45 made of silicon dioxide, silicon nitride, or other compounds, is deposited (see FIG. 23(*i*)), (*8*) contact halls 45*a* are formed on the interlayer insulating film 45 (FIG. 23(*j*)), and (9) metal wires 46 are formed on the contact halls 45 with alminium etc. (see FIG. 23(*k*)).

The maximum temperature to be applied in the above processes is not more than 600° C. which occurs when the gate insulating film 43 is formed. Therefore, it is not required to use an expensive quartz substrate which has extremely high heat resistance, instead, low cost glass having high heat resistance may be used such as the glass 1737 provided by Corning Inc. of the United States, thereby realizing a liquid crystal display device that can be provided at a low price.

In addition, in manufacturing the liquid crystal display device, although not shown, a transparent electrode (in the case of transmissive liquid crystal display device) or a reflective electrode (in the case of reflective liquid crystal display device) is provided on the thin film transistor manufactured in the described manner through another interlayer insulating film.

According to the described processes, the polycrystal silicon thin film transistor can be provided on a low-cost-glass substrate having a large area, thereby realizing a liquid crystal display device that can be provided at a low cost and in a larger size with ease.

Further, this polycrystal silicon thin film transistor formed by the described processes at a relatively low temperature has a larger element size and higher driving voltage compared with the monocrystal silicon thin film transistor. For this reason, in the case of adopting the polycrystal silicon thin film transistor as the thin film transistor constituting the source driver 33, the power consumption associated with the image signal and the clock signal increases. In spite of this, since the source driver 33 is realized by any one of the first through fifth data signal output circuits, the power consumption can be reduced, and it is possible to take an advantage of the property of the polycrystal silicon thin film transistor such as high mobility.

Figure 24:
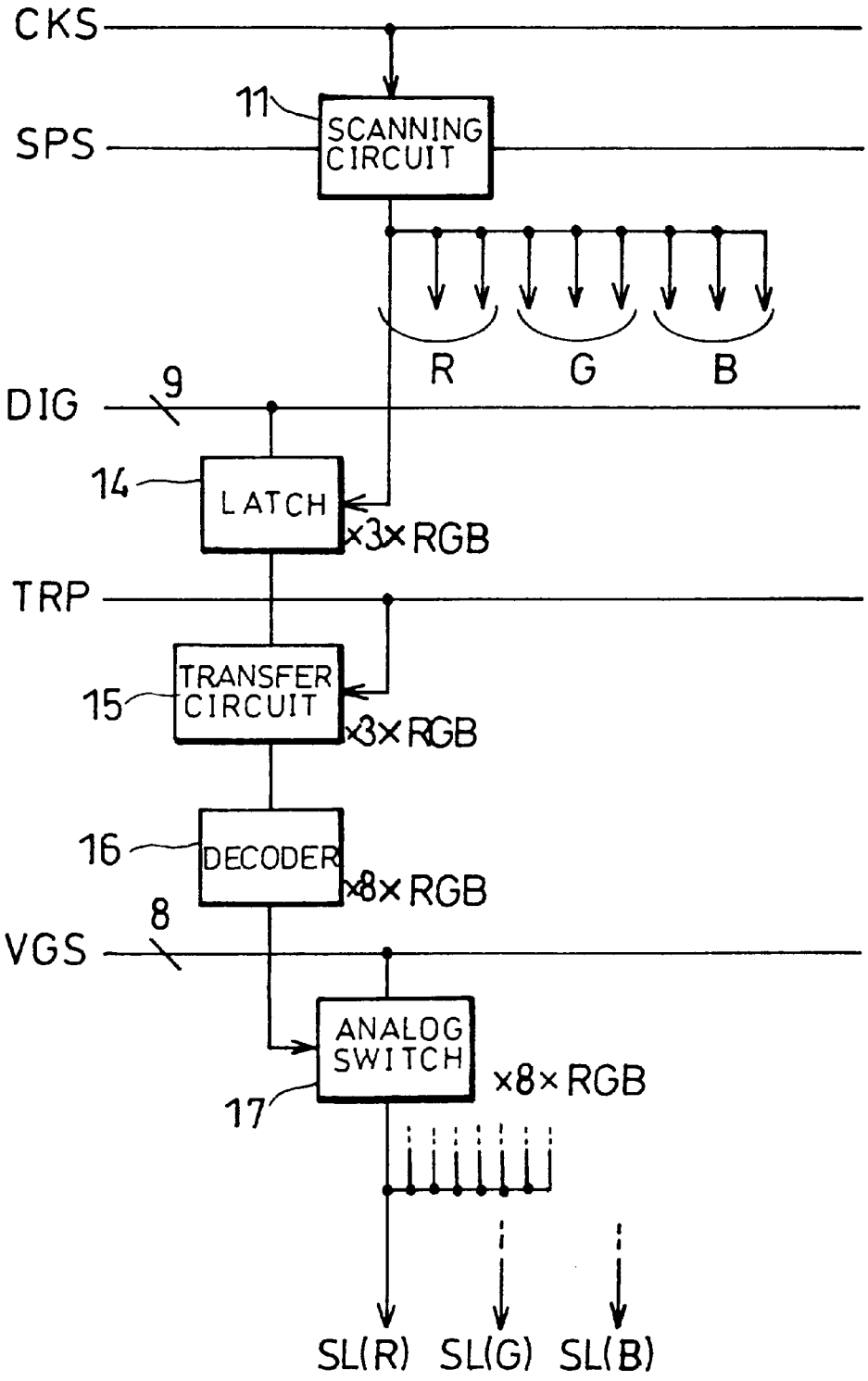
FIG. 24 is a block diagram showing an arrangement of a source driver (data signal output circuit) employed in the first and second liquid display devices and a conventional liquid display device.

The following will explain examples of the source driver 33 adopted by the first or second liquid crystal display device referring to FIG. 24.

The input to the source driver 33 are image signals DIG (corresponding to 512 colors) of 9 bits consisting of 3 bit signals for each of 3 three primary colors R, G, B. Here, the source driver 33 is a digital source driver of the multi-plexer system, and is provided with a scanning circuit 11, a latch 14, a transfer circuit 15, a decoder 16, and analog switches 17.

A set of the latch 14, the transfer circuit 15, and the decoder 16 is provided for each RGB, and 8 analog switches 17 are provided for each RGB.

The scanning circuit 11 corresponds to the shift register section 21, and shifts the start pulse SPS one after another to the following scanning circuit 11 in response to the clock signal CKS. Then, 3 pulse signals for each RGB are outputted from the scanning circuit 11.

The latch 14 makes a sampling of 3 bit signals for each RGB from the image signal DIG in synchronism with the three pulse signals which are outputted simultaneously from the scanning circuit 11. The transfer circuit 15 transfers the image signal DIG corresponding to one horizontal scanning period during a horizontal blanking period at once. The decoder 16 outputs 8 decoded signals by carrying out a decoding process with respect to the 3 bit signals of each RGB sampled by the latch 14. The decoded signals are activated in different periods of time.

The 8 analog switches 17 of each RGB are individually connected to 8 gradation power source lines. One of the analog switches 17 is switched on for each RGB in response to the decoded signal from the decoder 16 so as to output the gradation voltage VGS on the gradation power source lines.

Here, different gradation voltages VGS are supplied to the gradation power source lines by the power source circuit 7.

The latch 14, the transfer circuit 15, the decoder 16, and the analog switches 17 of each RGB constitute the driving section 22.

In the source driver having the above arrangement, the image signal DIG is sampled by the latch 14 in synchronism with the pulse signal SRP from the scanning circuit 11. The signals thus sampled are summarized and transferred to the decoder 16 in synchronism with the transfer signal TRP by the transfer circuit 15 during a horizontal blanking period. In decoder 16, the 3 bit signals from the latch 14 are decoded so that the 8 decoded signals are generated.

Then, one of the 8 gradation voltages VGS is selected by the analog switches 17 according to the decoded signal. Here, the transfer circuit 15 transfers the signals so as to secure a period of time in which the gradation voltages VGS are outputted to the data signal lines SL, such a period of time corresponding to substantially one horizontal scanning period. The gradation voltages VGS for each RGB as selected are outputted to respective data signal lines SL(R), SL(G), and SL(B) via the analog switches 17.

In the source driver such as above, the image signal DIG and the clock signal CLK are selectively supplied by a supply circuit of any one of the first through fifth data signal output circuits so as to greatly reduce the power consumption associated with the image signal DIG and the clock signal CLK. As a result, even in the liquid crystal display device having a digital source driver of the multi-plexer system, the power consumption can be reduced with ease.

Further, in the source driver of the present embodiment, since the gradation voltages VGS (display-use data signal) are outputted according to the image signals DIG of a plurality of bits, a circuit, which consumes a large amount of power such as an amplifier, is not required. Therefore, the power consumption associated with the supply of the image signal DIG and the clock signal CKS, etc. constitute a large proportion of the power consumption of the source driver. However, in the source driver of the present embodiment, as in the source driver 33, the effective load on the signal lines can be reduced, thereby reducing the power consumption of the source driver.

Figure 25:
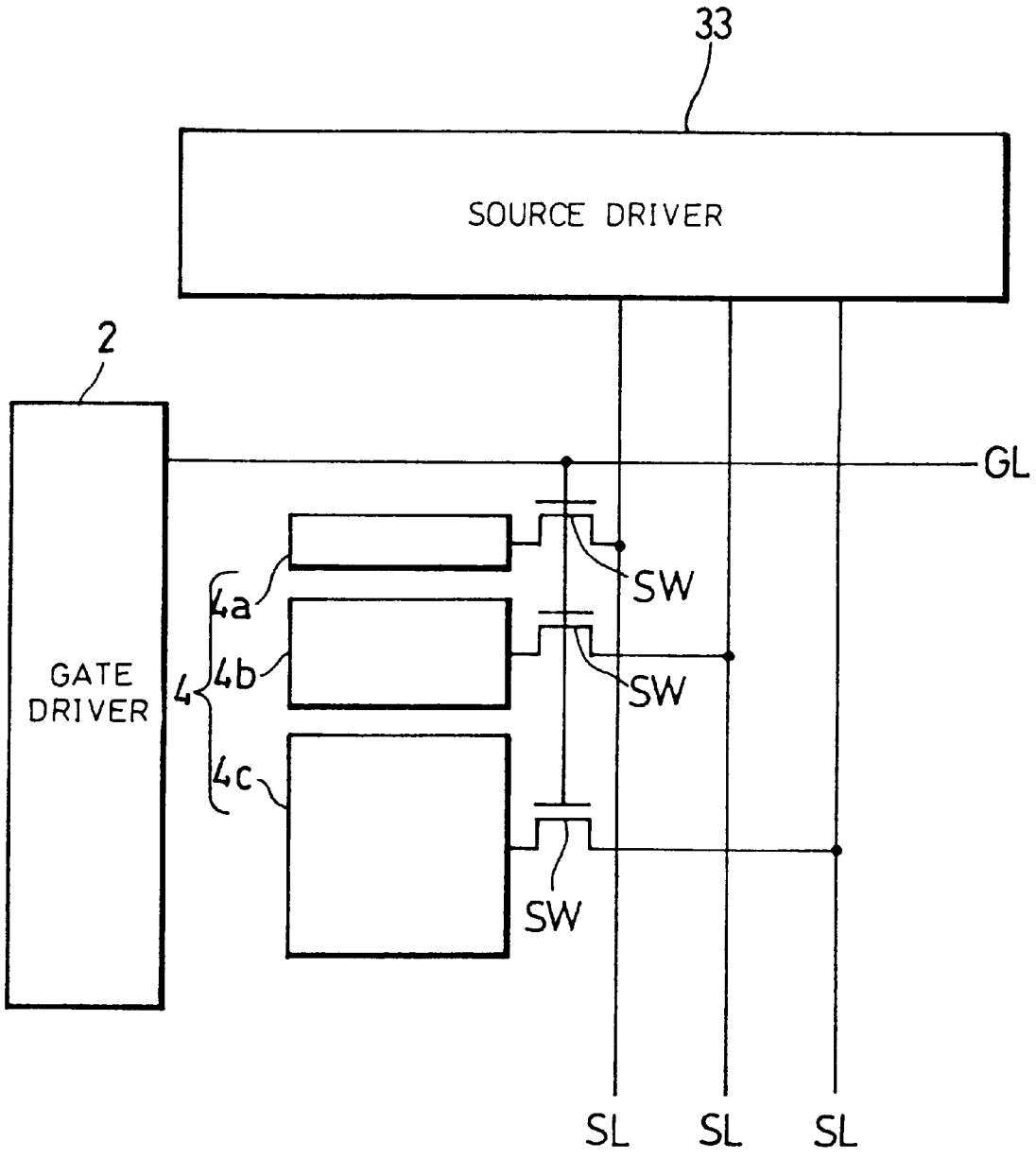
FIG. 25 is a block diagram showing an arrangement of a third liquid crystal display device in accordance with another embodiment of the present invention.

A third liquid crystal display device has the same arrangement as the first or second liquid crystal display device except with respect to the pixel 4, which has a different arrangement as shown in FIG. 25. Namely, each pixel 4 of the third liquid crystal display device is provided with three sub-pixels 4*a* through 4*c* having different areas. Each of three sub-pixels 4*a* through 4*c* is connected to a different data signal line SL through a different pixel transistor SW. Further, the sub-pixels 4*a* through 4*c* are driven by binary signals (gradation display-use data), and the gradation display is carried out based on each area ratio.

The above-mentioned displaying method is called an area gradation displaying method. According to this displaying method, since the sub-pixels are driven by the binary signals, it is possible to avoid that the gradation display-use data is affected not only by the non-uniform properties of the pixel transistors SW but also by noise. Therefore, high quality displaying can be achieved even in the source driver 33 realized by the thin film transistor.

Figure 26:
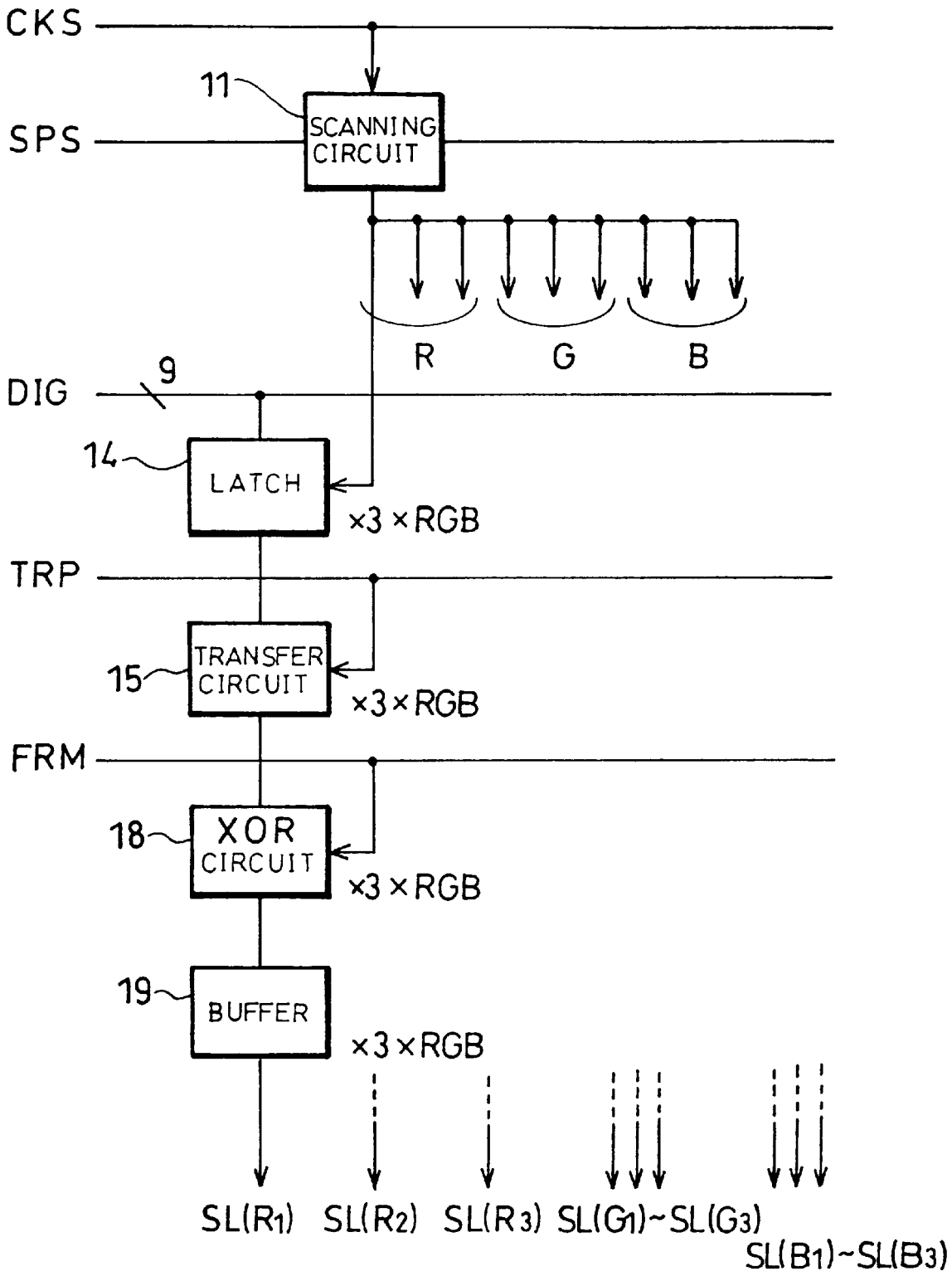
FIG. 26 is a block diagram showing an arrangement of a source driver (data signal output circuit) employed in the third liquid display device.
Figure 27:
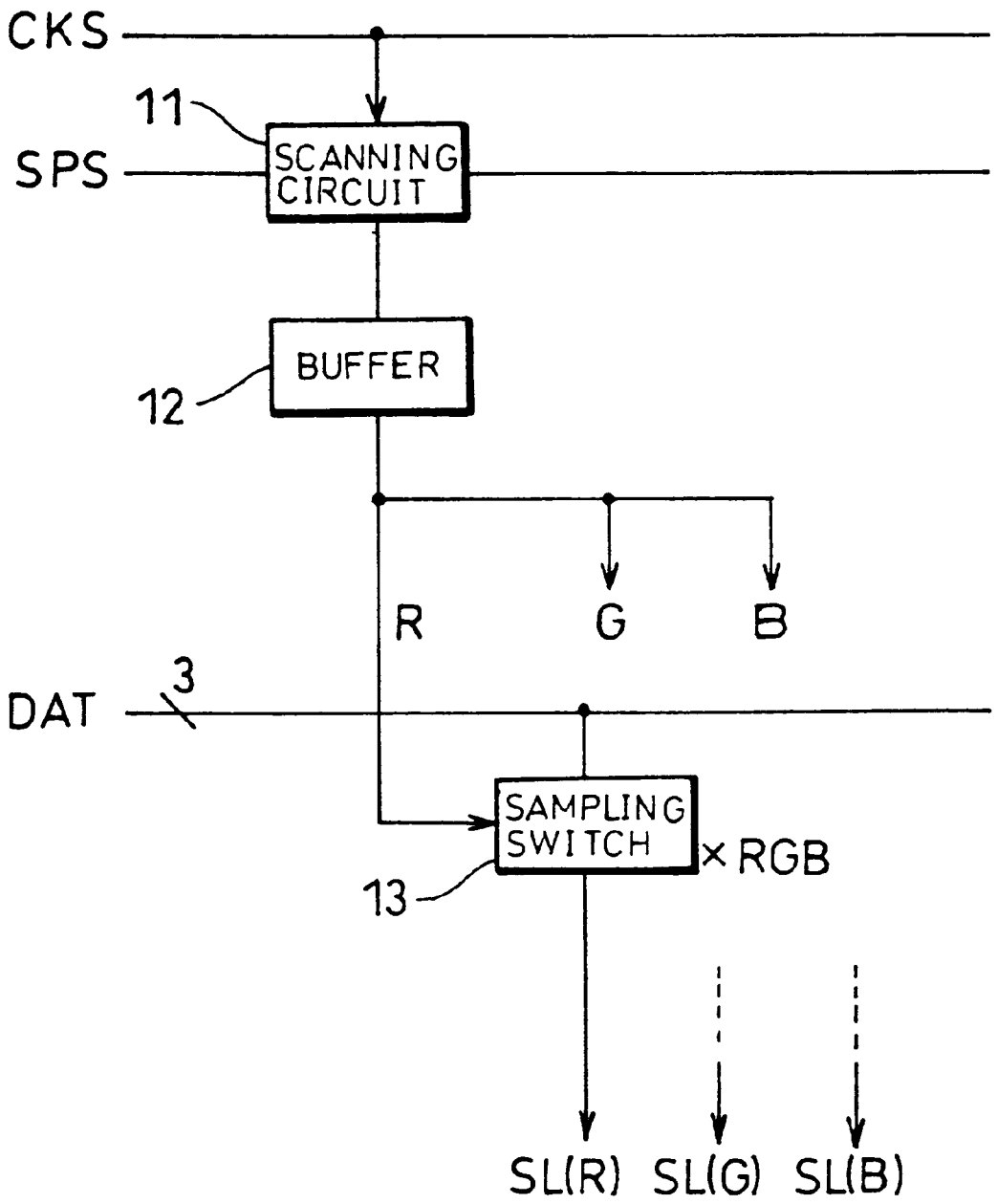
FIG. 27 (PRIOR ART)
FIG. 27 is a block diagram showing an arrangement of a conventional analog type source driver of a point sequential driving system.

In order to realize the area gradation displaying method, as shown in FIG. 26, the source driver 33 of the third liquid crystal display device is provided with a scanning circuit 11, a latch 14, a transfer circuit 15, an exclusive OR circuit (XOR circuit in FIG. 26) 18, and a buffer 19. Three sets (the same number of bits (9) of the image signal DIG) of the latch 14, the transfer circuit 15, the exclusive OR circuit 18, and the buffer 19 are provided for each RGB. In the exclusive OR circuit 18, (1) a reverse signal FRM, which is reversed according to a period of alternating driving, and (2) a signal sampled by the latch 14 are subjected to the exclusive OR.

In the source driver 33 having the above-described arrangement, as in the source driver of the multi-plexer system, the image signals DIG of 9 bits are sampled bit by bit by the latch 14 in synchronism with the pulse signal from the scanning circuit 11. The transfer circuit 15 transfers the image signals corresponding to one horizontal scanning period from the latch 14 during a horizontal blanking period.

Then, the signals thus transferred and the reverse signal FRM are subjected to the exclusive OR in the exclusive OR circuit 18. The output signals from the exclusive OR circuit 18 are outputted to respective data signal lines $SL(R_1)$ to $SL(R_3)$ of R (red), data signal lines $SL(G_1)$ to $SL(G_3)$ of G (green), and data signal lines $SL(B_1)$ to $SL(B_3)$ of B (blue) after buffered by the buffer 19 in order to be converted to a voltage required for displaying.

In the source driver 33 such as above, the image signal DIG and the clock signal CLK are selectively supplied by using a supply circuit of any one of the first through fifth data signal output circuits so as to greatly reduce the power consumption associated with the image signal and the clock signal. As a result, the power consumption of the third liquid crystal display device, which is suited for the area gradation displaying method, can be reduced.

Further, in the source driver 33 such as above, displaying is carried out so that gradations are expressed by the binary gradation display-use data (display-use data signal) supplied to each of the sub-pixels 4*a* to 4*c*. In other words, displaying is carried out by the so-called area gradation displaying method. Here, because the gradation display-use data are supplied to the sub-pixels 4*a* to 4*c* according to each bit of the image signal DIG, the source driver 33 does not require a circuit which consumes a large amount of power such as an amplifier. For this reason, the power consumption associated with the supply of the image signal DIG and the clock signal CKS, etc. constitute a large proportion of the power consumption of the source driver 33. However, as in the source driver of FIG. 24, the effective load on the signal lines can be reduced, thereby reducing the power consumption of the source driver 33.

Moreover, since the gradation display-use data are binary, it is likely to avoid that the gradation display-use data is affected by the non-uniform properties of the elements (transistors) constituting the source driver 33, thereby achieving better displaying compared with those of the first and second liquid crystal display devices.

In the present embodiment, explanations are given to the case where the data signal output circuit of the present invention is employed in the liquid crystal display device. Nonetheless, the data signal output circuit of the present invention may be employed in other image display devices having the same object to be achieved, or the data signal output circuit of the present invention may be employed in a circuit, a device, etc. of other fields.

The invention being thus described, it will be understood that many variations and modifications are possible. Such variations are not to be regarded as a departure from the spirit and scope of the invention, and all such modifications as would be apparent to one skilled in the art are intended to be included within the scope of the following claims.

What is claimed is:

1. A data signal output circuit divided into a plurality of blocks, comprising:

a shift register shifting a scanning signal to output the scanning signal in synchronism with a clock signal, said shift register being divided into a plurality of parts in accordance with said blocks;

a select output unit sampling an inputted digital signal in synchronism with the scanning signal, and outputting a data signal corresponding to the sampled digital signal to a plurality of output lines, said select output unit being divided into a plurality of parts in accordance with said shift register; and a first supply circuit, provided in each said block, for supplying the digital signal to a divided part of said select output unit in each said block at least during a period of time in which said divided part should operate.

2. The data signal output circuit as set forth in claim 1, wherein said first supply circuit is controlled to supply the digital signal to said divided part of said select output unit according to an externally applied block select signal.

3. The data signal output circuit as set forth in claim 2, wherein said first supply circuit includes AND gates for conducting logical AND with respect to said bit signals constituting each bit of the digital signal and the block select signal, the number of said AND gates being coincident with that of bits of the digital signal.

4. The data signal output circuit as set forth in claim 2, wherein respective block select signals to be sent to adjacent blocks are activated for a predetermined overlapped period of time to avoid missing a head end portion and a tail end portion of the digital signal.

5. The date signal output circuit as set forth in claim 1, wherein said first supply circuit includes a select circuit for generating the block select signal which controls supplying of the digital signal, said select circuit generating the block select signal according to a pulse signal outputted from a predetermined output stage of the shift register.

6. The data signal output circuit as set forth in claim 5, wherein said select circuit includes an RS flip-flop and an inverter which is provided in the following step of the RS flip-flop.

7. The data signal output circuit as set forth in claim 6, wherein said first supply circuit includes AND gates for conducting logical AND with respect to said bit signals constituting each bit of the digital signal and the block select signal, the number of said AND gates being coincident with that of bits of the digital signal.

8. The data signal output circuit as set forth in claim 6, wherein the RS flip-flop of the select circuit in a following block is set by the pulse signal outputted from the last output stage of the shift register in a preceding block, the preceding block and the following block being adjacent, and the RS flip-flop of the select circuit in the preceding block is reset by the pulse signal outputted from a first output stage of the shift register in the following block.

9. The data signal output circuit as set forth in claim 1, further comprising:

a second supply circuit, provided in each said block, for supplying the clock signal to a divided shift register of each said block at least during a period of time in which said divided shift register should operate, wherein said first supply circuit is controlled to supply the digital signal to said divided part of said select output unit according to an externally applied block select signal, and said second supply circuit is controlled to supply the clock signal to said divided part of said shift register according to the externally applied block select signal.

10. The data signal output circuit as set forth in claim 9, wherein said first supply circuit includes AND gates for conducting logical AND with respect to said bit signals constituting each bit of the digital signal and the block select signal, the number of said AND gates being coincident with that of bits of the digital signal, and said second supply circuit includes an AND gate for conducting logical AND with respect to the clock signal and the block select signal.

11. The data signal output circuit as set forth in claim 9, wherein respective block select signals to be sent to adjacent blocks are activated for a predetermined overlapped period of time so as to avoid that a head end portion and a tail end portion of the digital signal are missing.

12. The data signal output circuit as set forth in claim 1, further comprising:

a second supply circuit, provided in each said block, for supplying the clock signal to a divided shift register of each said block at least during a period of time in which said divided shift register should operate, wherein said first supply circuit is controlled to supply the digital signal to said divided part of said select output unit according to an externally applied first block select signal, and said second supply circuit is controlled to supply the clock signal to said divided part of said shift register according to an externally applied second block select signal.

13. The data signal output circuit as set forth in claim 12, wherein said first supply circuit includes AND gates for conducting logical AND with respect to said bit signals constituting each bit of the digital signal and the first block select signal, the number of said AND gates being coincident with that of bits of the digital signal, and said second supply circuit includes an AND gate for conducting logical AND with respect to the clock signal and the second block select signal.

14. The data signal output circuit as set forth in claim 12, wherein respective first block select signals to be sent to adjacent blocks are activated for a predetermined overlapped period of time so as to avoid that a head end portion and a tail end portion of the digital signal are missing.

15. The data signal output circuit as set forth in claim 14, wherein a time at which the second block select signal changes from an activated state to an inactivated state is delayed with respect to a time at which the first block select signal changes from an activated state to an inactivated state.

16. The data signal output circuit as set forth in claim 1, further comprising:

a second supply circuit, provided in each said block, for supplying the clock signal to a divided shift register of each said block at least during a period of time in which said divided shift register should operate, wherein said first and second supply circuits include a select circuit for generating the block select signal which controls supplying of the digital signal and the clock signal, said select circuit generating the block select signal according to a pulse signal outputted from a predetermined output stage of the shift register.

17. The data signal output circuit as set forth in claim 16, wherein said select circuit includes an RS flip-flop and an inverter which is provided in the following step of the RS flip-flop.

18. The data signal output circuit as set forth in claim 17, wherein said select circuit includes an NAND gate instead of the inverter, the NAND gate conducting logical NAND with respect to an output signal from the RS flip-flop and an externally applied initialization signal, the initialization signal being activated upon turning on of the data signal output circuit.

19. The data signal output circuit as set forth in claim 18, wherein said first supply circuit includes AND gates for conducting logical AND with respect to said bit signals constituting each bit of the digital signal and the block select signal, the number of said AND gates being coincident with that of bits of the digital signal, and said second supply circuit includes an AND gate for conducting logical AND with respect to the clock signal and the block select signal.

20. The data signal output circuit as set forth in claim 18, wherein the RS flip-flop of the select circuit in a following block is set by the pulse signal outputted from the last output stage of the shift register in a preceding block, the preceding block and the following block being adjacent, and the RS flip-flop of the select circuit in the preceding block is reset by the pulse signal outputted from a second output stage of the shift register in the following block.

21. The data signal output circuit as set forth in claim 20, wherein respective block select signals to be sent to adjacent blocks are activated for a predetermined overlapped period of time so as to avoid that a head end portion and a tail end portion of the digital signal are missing.

22. The data signal output circuit as set forth in claim 1, further comprising:

a second supply circuit, provided in each said block, for supplying the clock signal to a divided shift register of each said block at least during a period of time in which said divided shift register should operate, wherein said first supply circuit includes a first select circuit for generating a first block select signal which controls supplying of the digital signal, said first select circuit generating the first block select signal according to a pulse signal outputted from a predetermined output stage of the shift register, and said second supply circuit includes a second select circuit for generating a second block select signal which controls supplying of the clock signal, said second select circuit generating the second block select signal according to a pulse signal outputted from a predetermined output stage of the shift register.

23. The data signal output circuit as set forth in claim 22, wherein said first select circuit includes a first RS flip-flop and a first inverter which is provided in the following step of the first RS flip-flop, and said second select circuit includes a second RS flip-flop and a second inverter which is provided in the following step of the second RS flip-flop.

24. The data signal output circuit as set forth in claim 23, wherein said second select circuit includes an NAND gate instead of the second inverter, the NAND gate conducting logical NAND with respect to an output signal from the second RS flip-flop and an externally applied initialization signal, the initialization signal being activated upon turning on of the data signal output circuit.

25. The data signal output circuit as set forth in claim 24, wherein said first supply circuit includes first AND gates for conducting logical AND with respect to said bit signals constituting each bit of the digital signal and the first block select signal, the number of said AND gates being coincident with that of bits of the digital signal, and said second supply circuit includes a second AND gate for conducting logical AND with respect to the clock signal and the second block select signal.

26. The data signal output circuit as set forth in claim 24, wherein the first and second RS flip-flops of respective first and second select circuits in a following block is set by the pulse signal outputted from the last output stage of the shift register in a preceding block, the preceding block and the following block being adjacent, the first RS flip-flop of the first select circuit in the preceding block is reset by the pulse signal outputted from a first output stage of the shift register in the following block, and the second RS flip-flop of the second select circuit in the preceding block is reset by the pulse signal outputted from a second output stage of the shift register in the following block.

27. An image display device, comprising:

a plurality of pixels arranged in a matrix; and a data signal output circuit for supplying a display-use data signal corresponding to a digital image signal which has been inputted as a digital signal to each said pixel, said data signal output circuit being divided into a plurality of blocks, said data signal output circuit including:

a shift register shifting a scanning signal to output the scanning signal in synchronism with a clock signal, said shift register being divided into a plurality of parts in accordance with the blocks;

a select output unit for making a sampling of an inputted digital signal in synchronism with the scanning signal, and for outputting a data signal corresponding to the sampled digital signal to a plurality of output lines, said select output unit being divided into a plurality of parts as said shift register;

a first supply circuit, provided in each said block, for supplying the digital signal to a divided part of said select output unit in each said block at least during a period of time in which said divided part should operate; and a writing control circuit for controlling writing of the display-use data signal into each said pixel.

28. The image display device as set forth in claim 27, wherein said first supply circuit is controlled to supply the digital signal to said divided part according to an externally applied block select signal.

29. The image display device as set forth in claim 28, wherein said first supply circuit includes AND gates, whose number is coincident with that of bits of bit signals constituting each bit of the digital signal, for conducting logical AND with respect to the block select signal and each of the bit signals.

30. The image display device as set forth in claim 28, wherein respective block select signals to be sent to adjacent blocks are activated for a predetermined overlapped period of time so as to avoid missing a head end portion and a tail end portion of the digital signal.

31. The image display device as set forth in claim 27, wherein said first supply circuit includes a select circuit for generating the block select signal which controls supplying of the digital signal, said select circuit generating the block select signal according to a pulse signal outputted from a predetermined output stage of the shift register.

32. The image display device as set forth in claim 31, wherein said select circuit includes an RS flip-flop and an inverter which is provided in the following step of the RS flip-flop.

33. The image display device as set forth in claim 32, wherein said first supply circuit includes AND gates for conducting logical AND with respect to said bit signals constituting each bit of the digital signal and the block select signal, the number of said AND gates being coincident with bits of the digital signal.

34. The image display device as set forth in claim 32, wherein the RS flip-flop of the select circuit in a following block is set by the pulse signal outputted from the last output stage of the shift register in a preceding block, the preceding block and the following block being adjacent, and the RS flip-flop of the select circuit in the preceding block is reset by the pulse signal outputted from a first output stage of the shift register in the following block.

35. The image display device as set forth in claim 27, wherein said data signal output circuit further includes a second supply circuit, provided in each said block, for supplying the clock signal to a divided shift register of each said block at least during a period of time in which said divided shift register should operate, wherein said first supply circuit is controlled to supply the digital signal to said divided part of said select output unit according to an externally applied block select signal, and said second supply circuit is controlled to supply the clock signal to said divided part of said register according to the externally applied block select signal.

36. The image display device as set forth in claim 35, wherein said first supply circuit includes AND gates for conducting logical AND with respect to said bit signals constituting each bit of the digital signal and the block select signal, the number of said AND gates being coincident with that of bits of the digital signal, and said second supply circuit includes an AND gate for conducting logical AND with respect to the clock signal and the block select signal.

37. The image display device as set forth in claim 35, wherein respective block select signals to be sent to adjacent blocks are activated for a predetermined overlapped period of time so as to avoid missing a head end portion and a tail end portion of the digital signal.

38. The image display device as set forth in claim 27, wherein said data signal output circuit further includes a second supply circuit, provided in each said block, for supplying the clock signal to a divided shift register of each said block at least during a period of time in which said divided shift register should operate, wherein said first supply circuit is controlled so as to supply the digital signal to said divided part of said select output unit according to an externally applied first block select signal, and said second supply circuit is controlled to supply the clock signal to said divided part of said register according to the externally applied second block select signal.

39. The image display device as set forth in claim 38, wherein said first supply circuit includes AND gates for conducting logical AND with respect to said bit signals constituting each bit of the digital signal and the first block select signal, the number of said AND gates being coincident with bits of the digital signal, and said second supply circuit includes an AND gate for conducting logical AND with respect to the clock signal and the second block select signal.

40. The image display device as set forth in claim 38, wherein respective first block select signals to be sent to adjacent blocks are activated for a predetermined overlapped period of time so as to avoid missing a head end portion and a tail end portion of the digital signal.

41. The image display device as set forth in claim 40, wherein a time at which the second block select signal changes from an active state to an inactive state is delayed with respect to a time at which the first block select signal changes from an active state to an inactive state.

42. The image display device as set forth in claim 27, wherein said data signal output circuit further includes a second supply circuit, provided in each said block, for supplying the clock signal to a divided shift register of each said block at least during a period of time in which said divided shift register should operate, wherein said first and second supply circuits share a select circuit for generating the block select signal which controls supplying of the digital signal and the clock signal, said select circuit generating the block select signal according to a pulse signal outputted from a predetermined output stage of the shift register.

43. The image display device as set forth in claim 42, wherein said select circuit includes an RS flip-flop and an inverter which is provided in the following step of the RS flip-flop.

44. The image display device as set forth in claim 43, wherein said select circuit includes an NAND gate instead of the inverter, the NAND gate conducting logical NAND with respect to an output signal from the RS flip-flop and an externally applied initialization signal, the initialization signal being activated upon turning on of the data signal output circuit.

45. The image display device as set forth in claim 44, wherein said first supply circuit includes AND gates for conducting logical AND with respect to said bit signals constituting each bit of the digital signal and the block select signal, the number of said AND gates being coincident with bits of the digital signal, and said second supply circuit includes an AND gate for conducting logical AND with respect to the clock signal and the block select signal.

46. The image display device as set forth in claim 44, wherein the RS flip-flop of the select circuit in a following block is set by the pulse signal outputted from the last output stage of the shift register in a preceding block, the preceding block and the following block being adjacent, and the RS flip-flop of the select circuit in the preceding block is reset by the pulse signal outputted from a second output stage of the shift register in the following block.

47. The image display device as set forth in claim 46, wherein respective block select signals to be sent to adjacent blocks are activated for a predetermined overlapped period of time so as to avoid missing a head end portion and a tail end portion of the digital signal.

48. The image display device as set forth in claim 27, wherein said data signal output circuit further includes a second supply circuit, provided in each said block, for supplying the clock signal to a divided shift register of each said block at least during a period of time in which said divided shift register should operate, wherein said first supply circuit includes a first select circuit for generating a first block select signal which controls supplying of the digital signal, said first select circuit generating the first block select signal according to a pulse signal outputted from a predetermined output stage of the shift register, and said second supply circuit includes a second select circuit for generating a second block select signal which controls supplying of the clock signal, said second select circuit generating the second block select signal according to a pulse signal outputted from a predetermined output stage of the shift register.

49. The image display device as set forth in claim 48, wherein said first select circuit includes a first RS flip-flop and a first inverter which is provided in the following step of the first RS flip-flop, and said second select circuit includes a second RS flip-flop and a second inverter which is provided in the following step of the second RS flip-flop.

50. The image display device as set forth in claim 49, wherein said second select circuit includes an NAND gate instead of the second inverter, the NAND gate conducting logical NAND with respect to an output signal from the second RS flip-flop and an externally applied initialization signal, the initialization signal being activated upon turning on of the data signal output circuit.

51. The image display device as set forth in claim 50, wherein said first supply circuit includes first AND gates for conducting logical AND with respect to said bit signals constituting each bit of the digital signal and the first block select signal, the number of said AND gates being coincident with that of bits of the digital signal, and said second supply circuit includes a second AND gate for conducting logical AND with respect to the clock signal and the second block select signal.

52. The image display device as set forth in claim 49, wherein the first and second RS flip-flops of respective first and second select circuits in a following block is set by the pulse signal outputted from the last output stage of the shift register in a preceding block, the preceding block and the following block being adjacent, the first RS flip-flop of the first select circuit in the preceding block is reset by the pulse signal outputted from a first output stage of the shift register in the following block, and the second RS flip-flop of the second select circuit in the preceding block is reset by the pulse signal outputted from a second output stage of the shift register in the following block.

53. The image display device as set forth in claim 27, wherein transistors comprising the data signal output circuit and the pixel are thin film transistors provided on a single substrate.

54. The image display device as set forth in claim 53, wherein said transistors are polycrystal silicon thin film transistors formed at a temperature of not more than 600° C.

55. The image display device as set forth in claim 27, wherein said select output unit selects one of a plurality of externally inputted gradation voltages according to the digital image signal of a plurality of bits so as to supply the gradation voltage as selected to the each said pixel as the display-use data signal.

56. The image display device as set forth in claim 55, wherein said select output unit includes:

a latch for making a sampling of the image signal in synchronism with the pulse signal from the shift register;

a transfer circuit for summarizing and transferring the image signal corresponding to one horizontal scanning period sampled by said latch during a horizontal blanking period;

a decoder for carrying out a decoding process with respect to the digital image signal from said transfer circuit so as to output decode signals which are activated in respective different periods of time; and analog switches which are switched on when the decode signal is activated so as to output the gradation voltage corresponding to the decode signal, the number of said analog switches being coincident with that of the decode signals.

57. The image display device as set forth in claim 27, wherein said pixel is divided into a plurality of sub-pixels corresponding to the number of bits of the inputted image signal, and said data signal output circuit supplies the binary display-use data signal to each said sub-pixel according to each bit of the image signal.

58. The image display device as set forth in claim 57, wherein said select output circuit includes:

a latch for making a sampling of the image signal in synchronism with the pulse signal from the shift register;

a transfer circuit for summarizing and transferring the image signal corresponding to one horizontal scanning period sampled by said latch during a horizontal blanking period; and an exclusive OR circuit for conducting exclusive OR with respect to a reverse signal and the image signal sampled by the latch, the reverse signal being reversed according to a period for alternating driving of the pixel.

* * * * *